US011041324B2

(12) United States Patent
Carter

(10) Patent No.: US 11,041,324 B2
(45) Date of Patent: Jun. 22, 2021

(54) PORTABLE ERECTABLE SHELTER

(71) Applicant: Mark C. Carter, Norco, CA (US)

(72) Inventor: Mark C. Carter, Norco, CA (US)

(73) Assignee: INTERNATIONAL E-Z UP, INC., Norco, CA (US)

( * ) Notice: Subject to any disclaimer, the term of this patent is extended or adjusted under 35 U.S.C. 154(b) by 0 days.

(21) Appl. No.: 16/421,426

(22) Filed: May 23, 2019

(65) Prior Publication Data

US 2019/0360232 A1 Nov. 28, 2019

Related U.S. Application Data

(60) Provisional application No. 62/676,138, filed on May 24, 2018.

(51) Int. Cl.

| | |
|---|---|
| ***E04H 15/50*** | (2006.01) |
| ***E04H 15/58*** | (2006.01) |
| ***E04H 15/56*** | (2006.01) |
| ***E04H 15/00*** | (2006.01) |

(52) U.S. Cl.

CPC ..... *E04H 15/50* (2013.01); *E04H 15/008* (2013.01); *E04H 15/56* (2013.01); *E04H 15/58* (2013.01)

(58) Field of Classification Search

CPC ..... E04H 15/008; E04H 15/50

See application file for complete search history.

(56) References Cited

U.S. PATENT DOCUMENTS

| | | | | |
|---|---|---|---|---|
| 3,559,353 A * | 2/1971 | Partridge | ..... | E04B 1/3441 135/131 |
| 4,156,433 A | 5/1979 | Beaulieu | | |
| 4,193,414 A | 3/1980 | Trochman | | |
| 4,924,896 A * | 5/1990 | Carter | ..... | A45B 11/00 135/117 |
| RE33,710 E * | 10/1991 | Zeigler | ..... | E04B 1/3211 52/109 |
| 5,596,844 A | 1/1997 | Kalinowski | | |
| 6,941,704 B2 * | 9/2005 | Chen | ..... | E04B 1/3441 135/128 |

(Continued)

FOREIGN PATENT DOCUMENTS

| | | | | |
|---|---|---|---|---|
| FR | 2638481 | 5/1990 | | |
| GB | 1068155 A * | 5/1967 | ..... | E04B 1/344 |
| WO | 2015181535 | 12/2015 | | |

OTHER PUBLICATIONS

International Search Report dated Oct. 8, 2019 for PCT Application No. PCT/US2019/33923.

*Primary Examiner* — Noah Chandler Hawk

(74) *Attorney, Agent, or Firm* — Seyfarth Shaw LLP; Puya Partow-Navid

(57) ABSTRACT

A portable erectable shelter may include a pair of wall panels arranged outermost from a pair roof panels. The pair roof panels may be between the pair of wall panels in a collapsed, vertical position of the shelter. The portable shelter may include a first outer wall truss link rotatably fixed to a sidewall of a first wall panel and having a first end pivotally secured to a first corner of a first roof panel and a free end opposite the first end. The portable shelter may further include a first outer roof truss link rotatably fixed to a sidewall of the first roof panel and including a first end pivotally secured to a first corner of the first wall panel. The first end of the first outer wall truss link may be arranged to abut the first end of the first outer roof truss link in an erect position.

9 Claims, 21 Drawing Sheets

(56) References Cited

U.S. PATENT DOCUMENTS

| | | | | |
|---|---|---|---|---|
| 7,533,498 | B2 * | 5/2009 | Zeigler | E04B 1/3205 135/128 |
| 7,712,261 | B2 * | 5/2010 | Zeigler | E04H 15/50 135/128 |
| 2008/0017233 | A1 | 1/2008 | Zeigler | |
| 2011/0252717 | A1 | 10/2011 | Fernandez | |
| 2012/0298162 | A1 | 11/2012 | Zeigler | |
| 2015/0218794 | A1 | 8/2015 | Martyn | |

* cited by examiner expanding position

Collapsed position

PORTABLE ERECTABLE SHELTER

CROSS-REFERENCE TO RELATED APPLICATION

The present application claims the benefit of U.S. Provisional Patent Application No. 62/676,138, filed on May 24, 2018, and titled "PORTABLE ERECTABLE SHELTER," the disclosure of which is expressly incorporated by reference in its entirety.

BACKGROUND

Field

Certain aspects of the present disclosure generally relate to folding, collapsible structures and, more particularly, to a portable and erectable structure.

Background

Portable erectable shelters, such as tents or screened rooms, can be transported and set up for various purposes. Conventional portable shelters include fabric that is erected with poles, ropes, and stakes. Although conventional portable shelters are easily transported, the assembly may be cumbersome. Furthermore, as most conventional portable shelters use extendible poles for support, the conventional portable erectable shelters are not durable.

For increased durability, non-erectable or semi-erectable shelters, such as pre-fabricated homes, may be used as a shelter. Although these types of shelters provide improved durability, they are difficult to transport and assemble. Accordingly, there is a need for a portable erectable shelter with a reduced assembly time and improved durability.

SUMMARY

A portable erectable shelter may include a pair of wall panels arranged outermost from a pair roof panels. The pair roof panels may be between the pair of wall panels in a collapsed, vertical position of the shelter. The portable shelter may include a first outer wall truss link rotatably fixed to a sidewall of a first wall panel and having a first end pivotally secured to a first corner of a first roof panel and a free end opposite the first end. The portable shelter may further include a first outer roof truss link rotatably fixed to a sidewall of the first roof panel and including a first end pivotally secured to a first corner of the first wall panel. The first end of the first outer wall truss link may be arranged to abut the first end of the first outer roof truss link in an erect position.

A portable, erectable shelter may include inner truss links arranged on a first side of the erectable shelter and a second opposite side of the erectable shelter. The erectable shelter may also include outer truss links arranged on the first side and the second opposite side of the erectable shelter. Each of the outer truss link may be pivotally connected to one of the inner truss links between a first end of the outer truss link and a second end of the outer truss link. At least one end of each outer truss link pivotally attached to an adjacent inner truss link. The erectable shelter may further include link connectors. Each link connector connects one end of an inner truss link on the first side to an end of an inner truss link on the second opposite side.

This has outlined, rather broadly, the features and technical advantages of the present disclosure in order that the detailed description that follows may be better understood.

Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The features, nature, and advantages of the present disclosure will become more apparent from the detailed description set forth below when taken in conjunction with the drawings in which like reference characters identify correspondingly throughout.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Based on the teachings, one skilled in the art should appreciate that the scope of the disclosure is intended to cover any aspect of the disclosure, whether implemented independently of or combined with any other aspect of the disclosure. For example, an apparatus may be implemented or a method may be practiced using any number of the aspects set forth. In addition, the scope of the disclosure is intended to cover such an apparatus or method practiced using other structure, functionality, or structure and functionality, in addition to or other than the various aspects of the disclosure set forth. It should be understood that any aspect of the disclosure disclosed may be embodied by one or more elements of a claim.

The word "exemplary" is used herein to mean "serving as an example, instance, or illustration." Any aspect described herein as "exemplary" is not necessarily to be construed as preferred or advantageous over other aspects.

Although particular aspects are described herein, many variations and permutations of these aspects fall within the scope of the disclosure. Although some benefits and advantages of the preferred aspects are mentioned, the scope of the disclosure is not intended to be limited to particular benefits, uses or objectives. Rather, aspects of the disclosure are intended to be broadly applicable to different technologies, structural configurations, fabrics, and materials, some of which are illustrated by way of example in the figures and in the following description of the preferred aspects. The detailed description and drawings are merely illustrative of the disclosure, rather than limiting the scope of the disclosure being defined by the appended claims and equivalents thereof.

A foldable (e.g., collapsible) shelter may be used in various scenarios. For example, the foldable shelter may be used as a display booth, a shelter, an exhibit, a storefront, etc. The foldable shelter may be referred to as a shelter. The shelter may include three or more sides. The sides may be of different sizes (e.g., lengths) or the same size.

Figure 1:
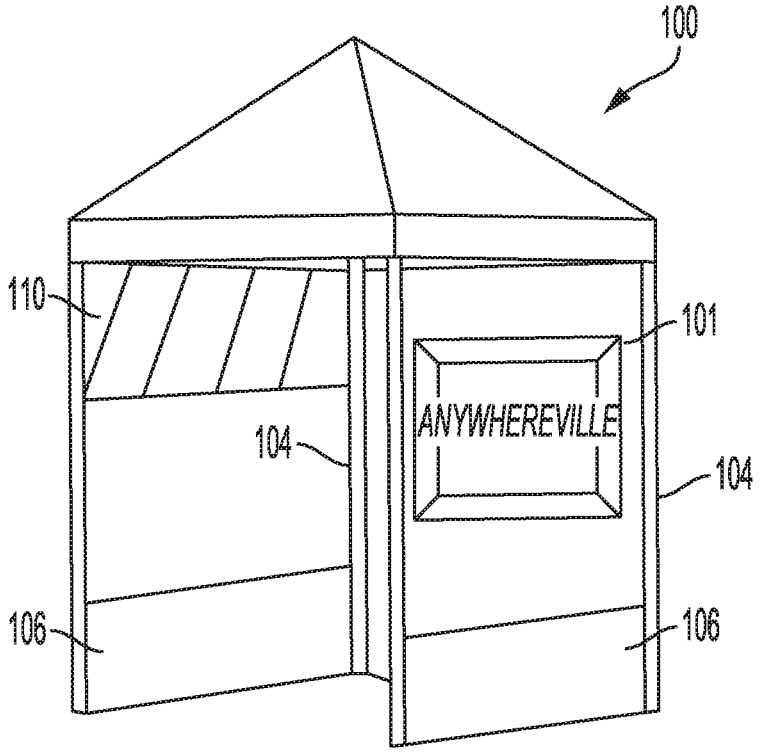
FIG. 1 (PRIOR ART)
FIG. 1 illustrates an example of a conventional shelter.

FIG. 1 illustrates an example of a conventional shelter 100 with sidewalls 101 and side skirts 106 attached to legs 104. The sidewalls 101 and side skirts 106 may be formed of a fabric material such as a polyester fabric. In conventional systems, the sidewalls 101 and side skirts 106 may attach directly to the legs 104 or perimeter truss via a connection, such as a fastener attached to a strap. The connections are neither secure nor taut. Therefore, the sidewalls 101 and side skirts 106 are prone to sagging or disconnecting from the legs 104. Additionally, or alternatively, banners, flags, and/or other types of dressings may be mounted to the legs and/or frame. As an example, half walls 110 may also be mounted to the legs 104.

As discussed above, conventional portable erectable shelters, such as the conventional shelter 100, are not durable. Unfortunately, an increase in durability generally reduces a shelter's portability. In some cases, conventional portable shelters are pre-fabricated shelters with a substantially rectangular body. Portions of the shelter body may expand and collapse. The conventional rectangular body shelters may be transported via a trailer or other transportation system. Nevertheless, these conventional rectangular body shelters are difficult to transport and often involve specific transportation systems, such as trailers, shipping containers, or flat-bed trucks. These specific transportation systems limit the areas capable of receiving conventional rectangular body shelters.

In some cases, conventional portable shelters may collapse and fold. For example, a foldable portable building is described and shown in U.S. Pat. No. 5,596,844. The conventional foldable building includes multiple roof, floor, and wall members that are foldable and extendible. The roof and floor members lie outermost and are extendible to form the floor and roof of the building. Multiple wall members are interconnected to extend and complete the building in a concertina manner from within the portable building. Still, the conventional foldable building is difficult to assemble. For example, the roof, the floor, and the walls are extended and arranged, piece by piece, into a shelter. As a result, these conventional erectable shelters often rely on electronics or other machines to expand and erect the shelter.

Aspects of the present disclosure are directed to an erectable and portable shelter with improved durability and reduced difficulty for assembly. The erectable and portable shelter may be referred to as an erectable shelter or an erectable house. In one configuration, the erectable shelter folds to a size that is less than a footprint of the erectable shelter, for example, as shown in FIG. 2.

Figure 2:
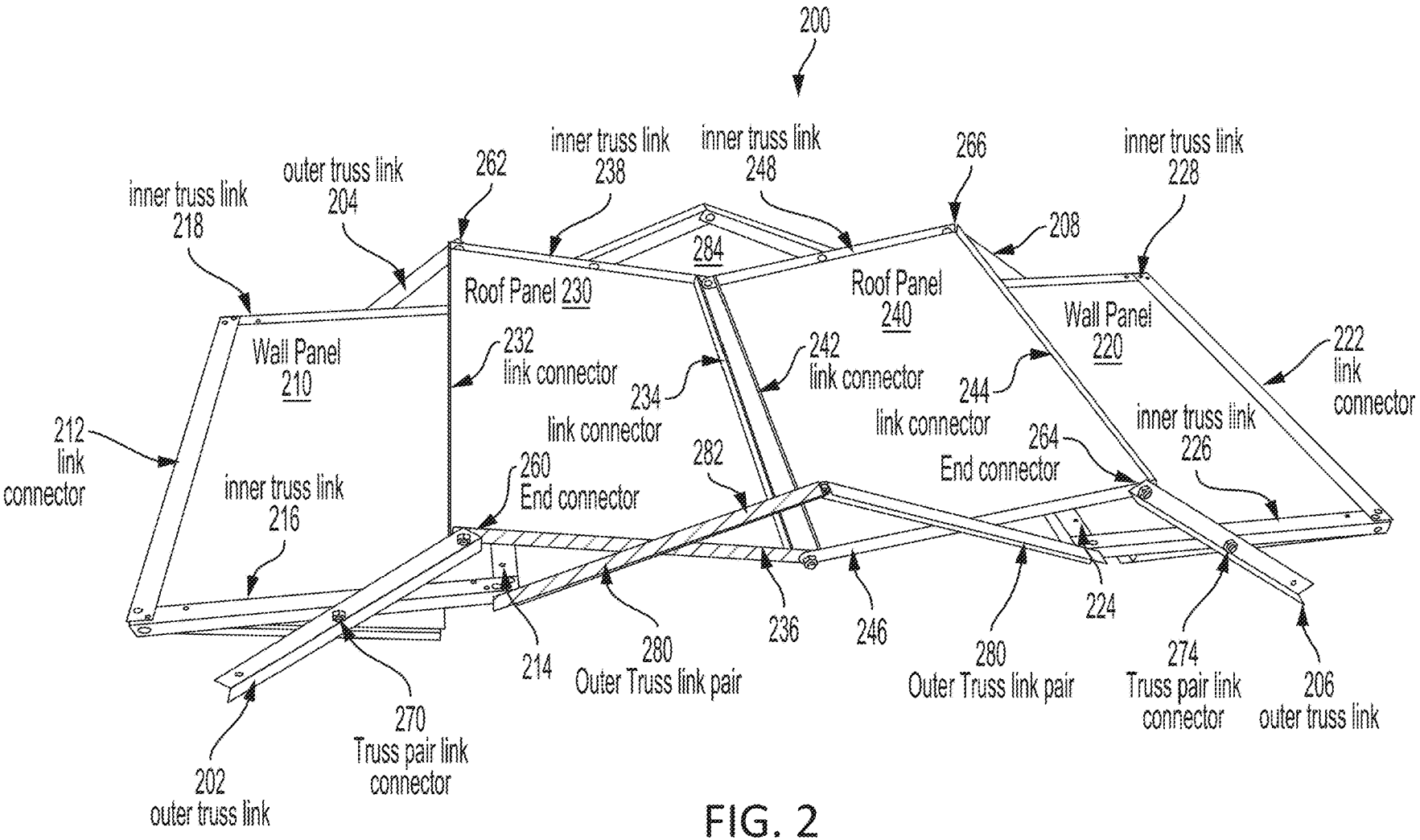
FIG. 2 illustrates a portable, erectable shelter, according to aspects of the present disclosure.

FIG. 2 illustrates a portable, erectable shelter 200, according to aspects of the present disclosure. Representatively, the portable, erectable shelter 200 includes a first wall panel 210, a second wall panel 220, a first roof panel 230, and a second roof panel 240. The first wall panel 210 is framed by a first link connector 212, a second link connector 214, a first inner truss link 216, and a second inner truss link 218, which may be referred to as inner truss links (e.g., a third inner truss link and a fourth inner truss link). The second wall panel 220 is framed by a first link connector 222, a second link connector 224, a first inner truss link 226, and a second inner truss link 228. The first roof panel 230 is framed by a first link connector 232, a second link connector 234, a first inner truss link 236, and a second inner truss link 238. The second roof panel 240 is framed by a first link connector 242, a second link connector 244, a first inner truss link 246, and a second inner truss link 248.

In this configuration, the first wall panel 210 is secured to the first roof panel 230 by a first outer wall truss link 202 and a second outer truss link 204 using a first end connector 260 and a second end connector 262. In addition, the second wall panel 220 is secured to the second roof panel 240 by a first outer truss link 206 and a second outer truss link 208 using a first end connector 264 and a second end connector 266. In this arrangement, the first wall panel 210 is secured to the first outer wall truss link 202 and the second outer truss link 204 using a first truss pair link connector 270 and a second truss pair link connector (not shown). Similarly, the second wall panel 220 is secured to the first outer truss link 206 and the second outer truss link 208 using a first truss pair link connector 274 and a second truss pair link connector (not shown).

Figure 3:
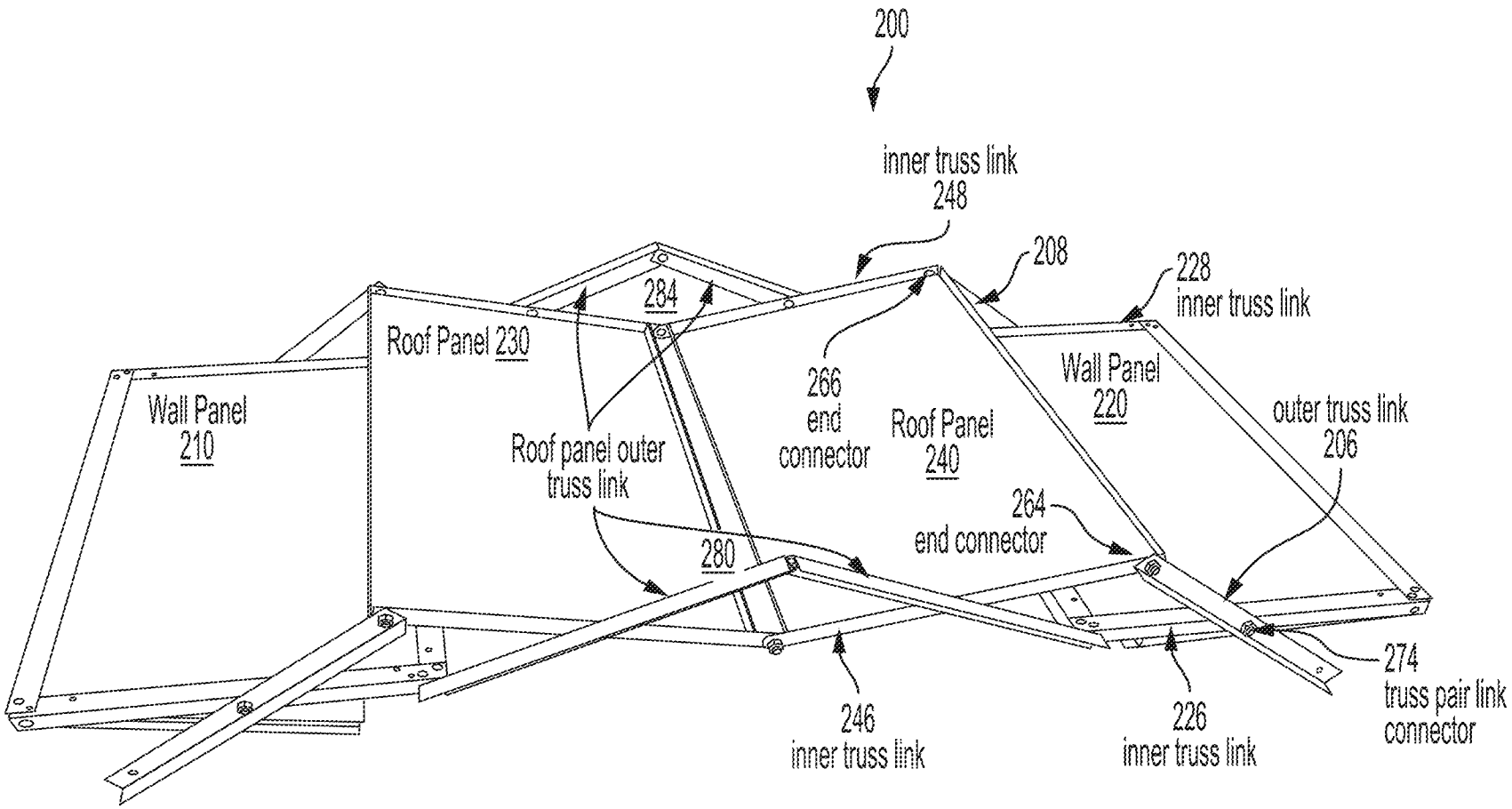
FIG. 3 further illustrates the portable, erectable shelter of FIG. 2, according to aspects of the present disclosure.
Figure 5:
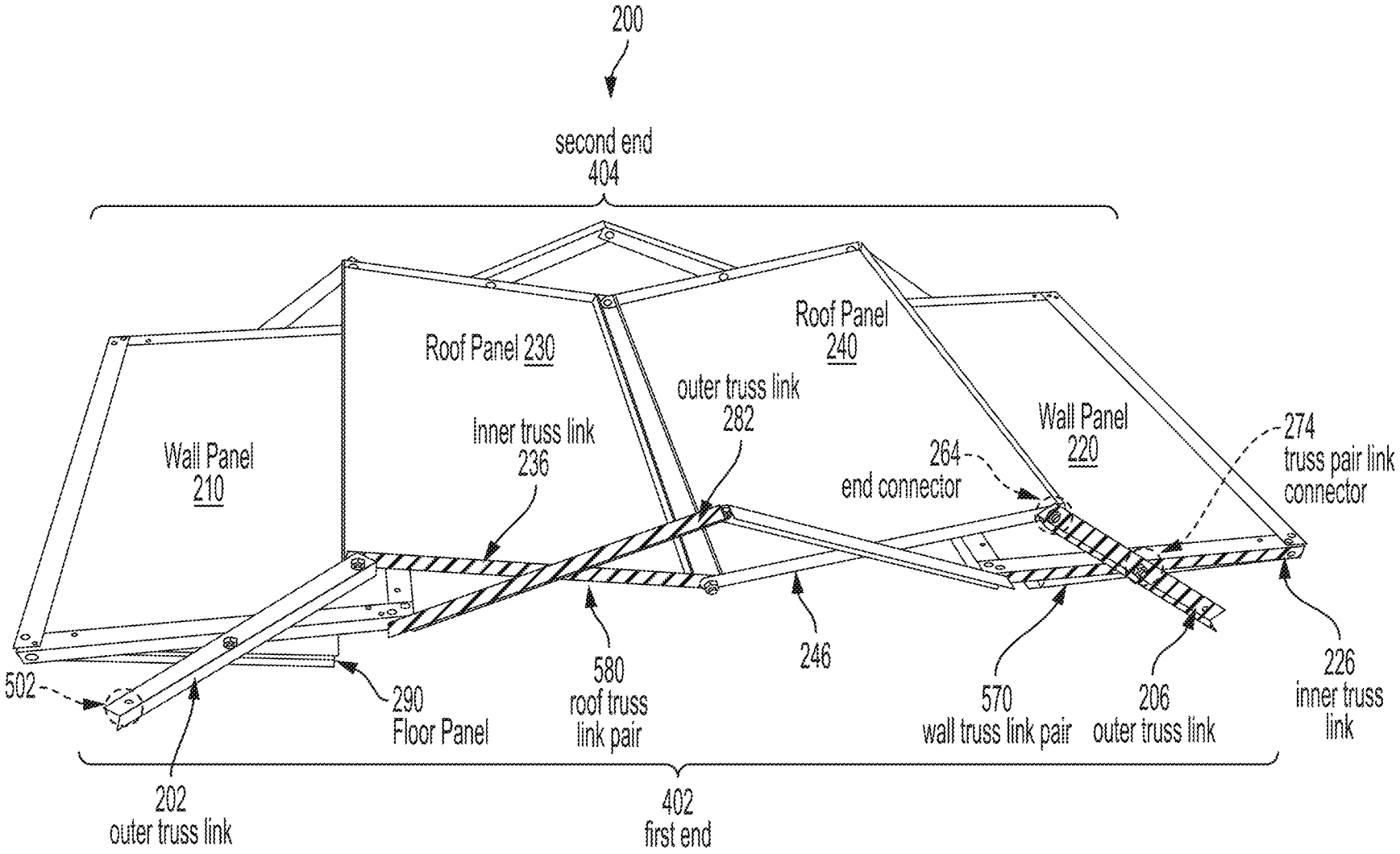
FIG. 5 further illustrates the portable, erectable shelter of FIG. 2, according to aspects of the present disclosure.

In one configuration, the first wall panel 210 and the second wall panel 220 are also connected by a first outer truss link pair 280 and a second outer truss link pair 284. As described herein, the first outer truss link pair 280 and the second outer truss link pair 284 may be referred to as roof panel outer truss links, for example, as shown in FIG. 3. In addition, a first outer roof truss link 282 is rotationally secured to the first inner truss link 236 to form a roof truss link pair, for example, as shown in FIG. 5.

FIG. 3 further illustrates the portable, erectable shelter 200 of FIG. 2, according to aspects of the present disclosure. In this example, the first outer truss link 206 is pivotally connected to the first inner truss link 226 of the second wall panel 220 through the first truss pair link connector 274. The first outer truss link 206 is also pivotally connected to the second roof panel 240 through the first end connector 264. Similarly, the second outer truss link 208 is pivotally connected to the second inner truss link 228 of the second wall panel 220 through a second truss pair link connector (not shown). In addition, the second outer truss link 208 is pivotally connected to a second inner truss link 228 through a second end connector 266.

FIG. 3 further illustrates the first outer truss link pair 280 and the second outer truss link pair 284, which are identified as roof panel outer truss links, and are rotationally connected to the first roof panel 230 and the second roof panel 240 through connectors (not shown). The first outer truss link pair 280 and the second outer truss link pair 284 are pivotally connected to the first wall panel 210 and the second wall panel 220 through end connectors (not shown). In this example, the first outer truss link pair 280 and the second outer truss link pair 284 are rotationally connected to an adjacent inner truss link, such as the first inner truss link 246 or the second inner truss link 248 of the second roof panel 240. These connections may form truss pair link connections, which may be off-center between each end of the truss links. In addition, a truss pair connection (e.g., the first end connector 264 and/or the second end connector 266) is defined between each end of an inner truss link (e.g., first inner truss link 246) and each end of an outer truss link (e.g., first outer truss link 206).

Figure 4:
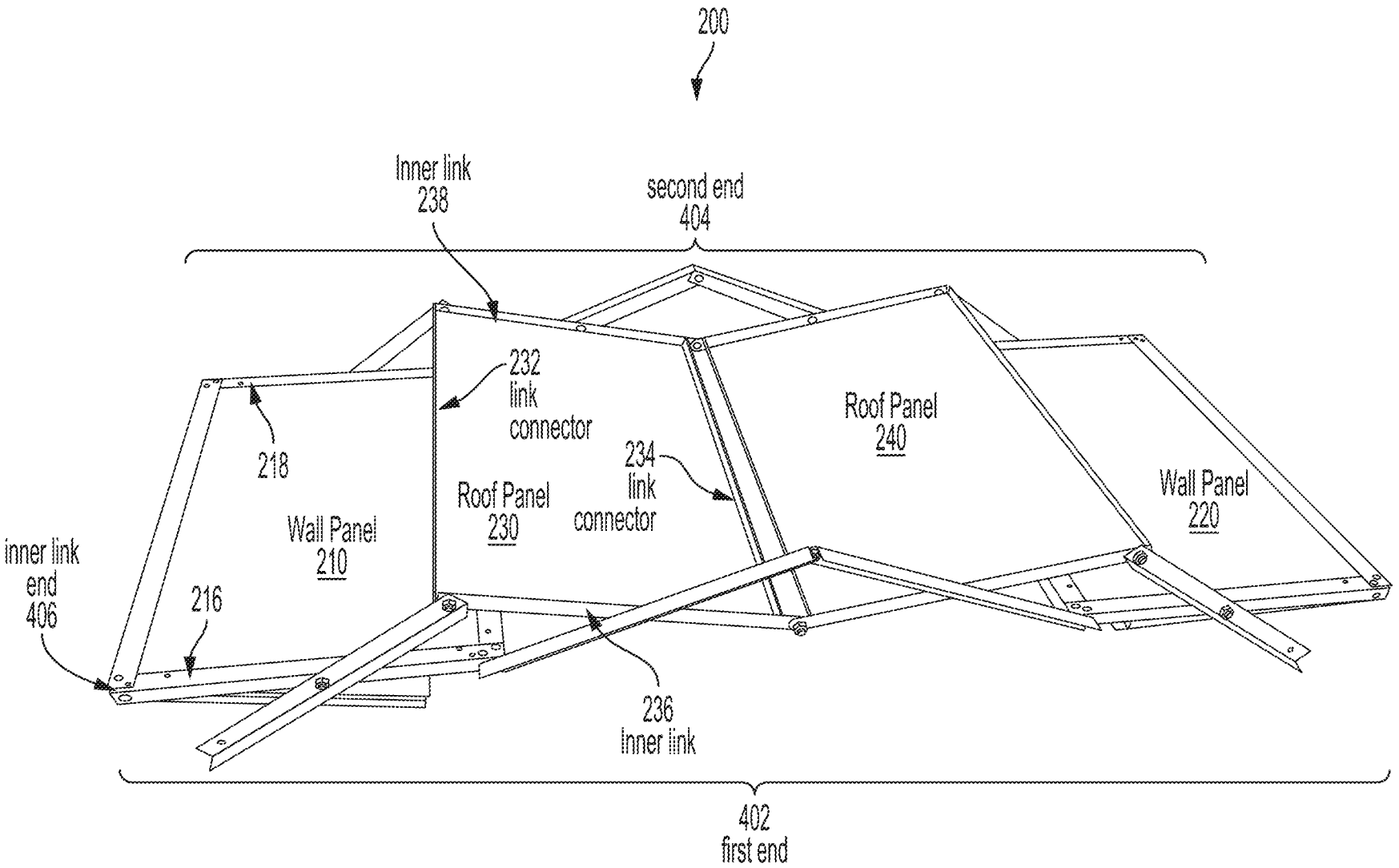
FIG. 4 further illustrates the portable, erectable shelter of FIG. 2, according to aspects of the present disclosure.

FIG. 4 further illustrates the portable, erectable shelter 200 of FIG. 2, according to aspects of the present disclosure. This example highlights the first link connector 232, the second link connector 234, the first inner truss link 216, and the second inner truss link 218, which are joined together to frame the first roof panel 230. In this configuration, a first end 402 of the portable, erectable shelter 200 includes the first inner truss link 236 that corresponds to the second inner truss link 238 on a second end 404 of the portable, erectable shelter 200. A rectangular shape may be formed when each end of the first inner truss link 236 is connected to ends of the second inner truss link 238 via the first link connector 232 and the second link connector 234. The rectangular shapes may be filled with material to form the first roof panel 230. This same configuration may be followed to form the second roof panel 240 as well as the first wall panel 210 and the second wall panel 220.

FIG. 5 further illustrates the portable, erectable shelter 200 of FIG. 2, according to aspects of the present disclosure. This example highlights a first roof truss link pair 580 of the first roof panel 230, and a first wall truss link pair 570 of the second wall panel 220. In this example, the first outer truss link 206 of the first wall truss link pair 570 has two connections: 1) the first end connector 264 to the first inner truss link 246; and 2) the first truss pair link connector 274 to the first inner truss link 226 of the second wall panel 220. In one configuration, a length of the first outer truss link 206 of the first wall truss link pair 570 is less than a length of the first outer roof truss link 282 of the first roof truss link pair 580.

In this configuration, the portable, erectable shelter 200 includes the first roof truss link pair 580 and the first wall truss link pair 570 on the first end 402. The portable, erectable shelter 200 also includes a second roof truss link pair (not shown) on the second end 404. For example, the first roof panel 230 includes the first roof truss link pair 580 on the first end 402 and a second roof truss link pair (not shown) on the second end 404. Similarly, portable, erectable shelter 200 includes wall truss link pairs on the second end 404. For example, the second wall panel 220 includes the first wall truss link pair 570 on the first end 402 and a second wall truss link pair (not shown) on the second end 404.

In one configuration, the first outer truss link 206 of the first wall truss link pair 570 has a similar length to the first outer roof truss link 282 of the first roof truss link pair 580. In another configuration, the length of the first outer truss link 206 of the first wall truss link pair 570 is less than the length to the first outer roof truss link 282 of the first roof truss link pair 580. Furthermore, one end of the first outer truss link 206 of the first wall truss link pair 570 of the second wall panel 220 is unconnected. Similarly, a free end 502 of the first outer wall truss link 202 of the first wall truss link pair 570 of the first wall panel 210 is also unconnected. Because the ends of the first outer wall truss link 202 and the first outer truss link 206 are unconnected to another structural element, the first wall panel 210 and the second wall panel 220 may be placed in a vertical position for extending a floor panel 290 secured to the first wall panel 210 through an inner link end 406 (of FIG. 4). In addition, the first roof panel 230 and the second roof panel 240 may be placed in an angled position, as shown in FIGS. 6A-6J.

FIGS. 6A-6J depict a process of erecting the portable, erectable shelter 200 of FIG. 2, according to aspects of the present disclosure. The process of erecting the portable, erectable shelter 200 of FIG. 2 begins at FIG. 6A.

Figure 6B:
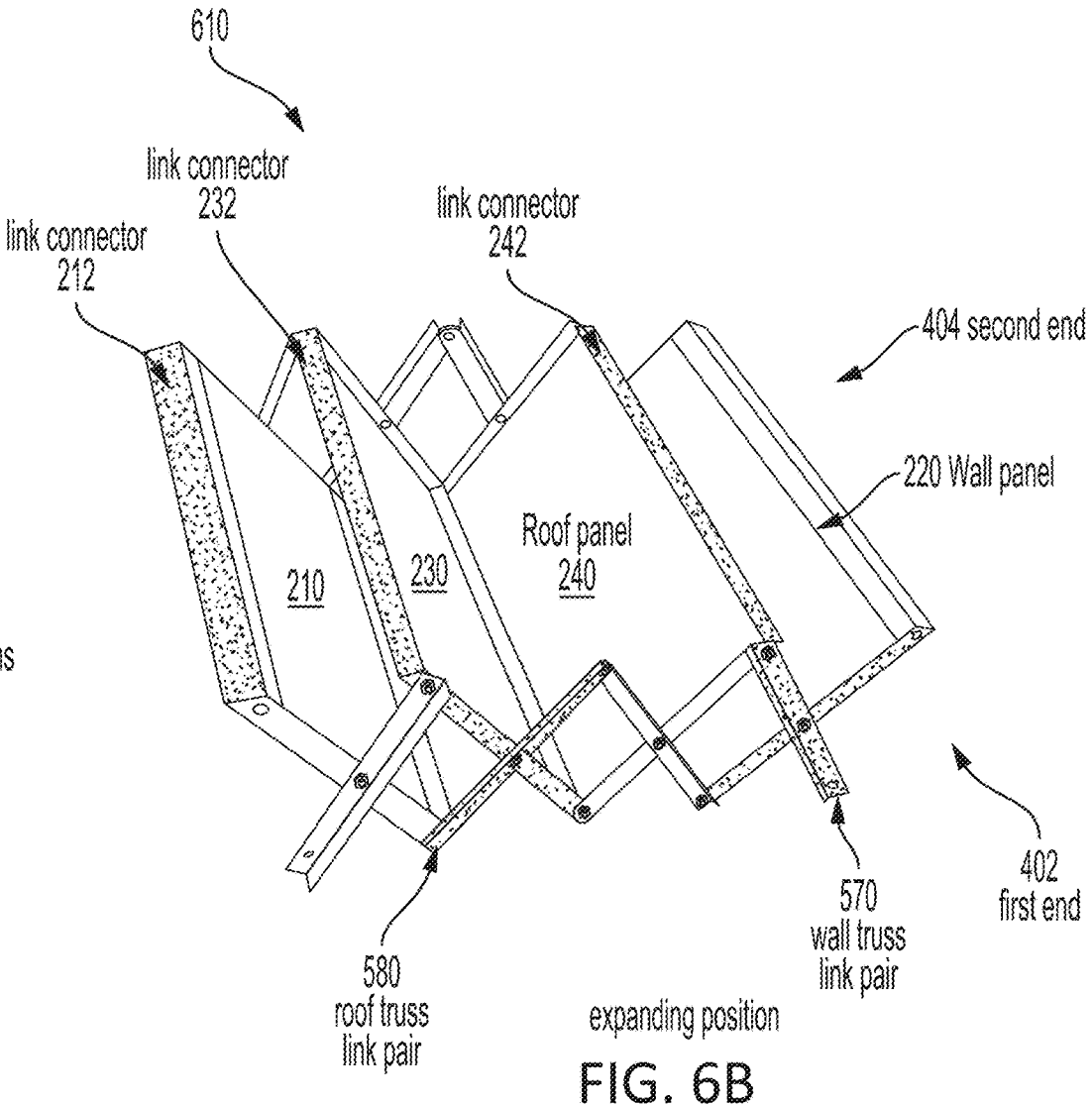
FIGS. 6A-6K depict a process of erecting the portable, erectable shelter of FIG. 2, according to aspects of the present disclosure.
Figure 6A:
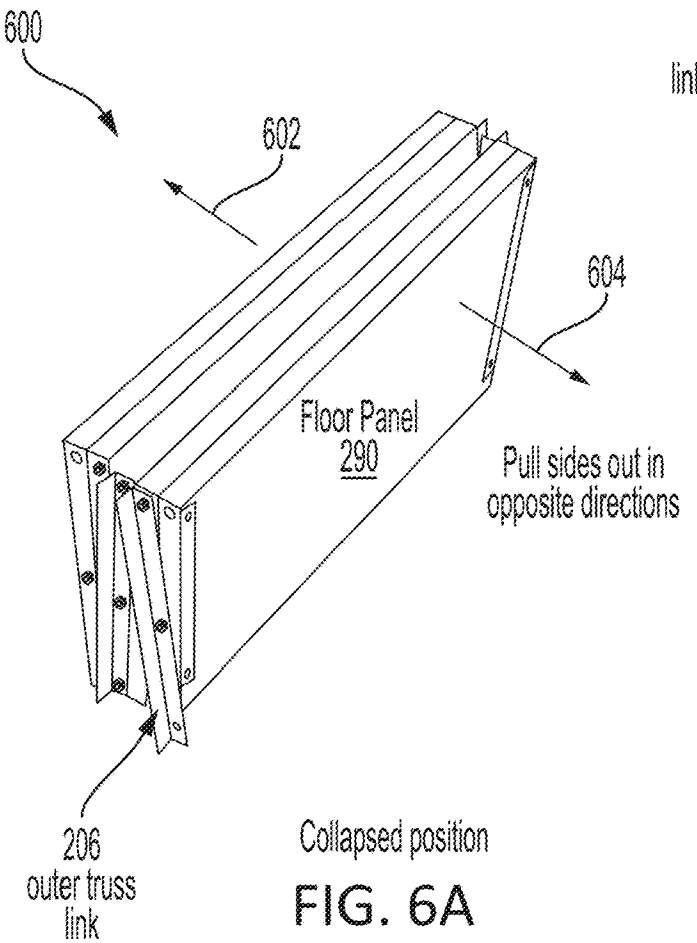

FIG. 6A illustrates the portable, erectable shelter 200 of FIG. 2 in a collapsed position 600. The collapsed position 600 of the portable, erectable shelter 200 shows the first outer truss link 206 as well as a floor panel 290 attached to the second wall panel 220 (as shown in FIG. 6B). The portable, erectable shelter 200 is transformed from the collapsed position 600 to the expanding position 610 (as shown in FIG. 6B) by pulling sides of the portable, erectable shelter 200 in opposite directions indicated by arrows 602 and 604.

FIG. 6B illustrates the portable, erectable shelter 200 of FIG. 2 in an expanding position 610 relative to the first end 402 and the second end 404. The expanding position 610 of the portable, erectable shelter 200 shows the first roof truss link pair 580 as well as the first wall truss link pair 570. In addition, the second roof panel 240 as well as the second wall panel 220 are also shown. The first link connector 212 of the first wall panel 210, the first link connector 232 of the first roof panel 230, and the first link connector 242 of the second roof panel 240 are also shown in the expanding position 610.

Figure 6D:
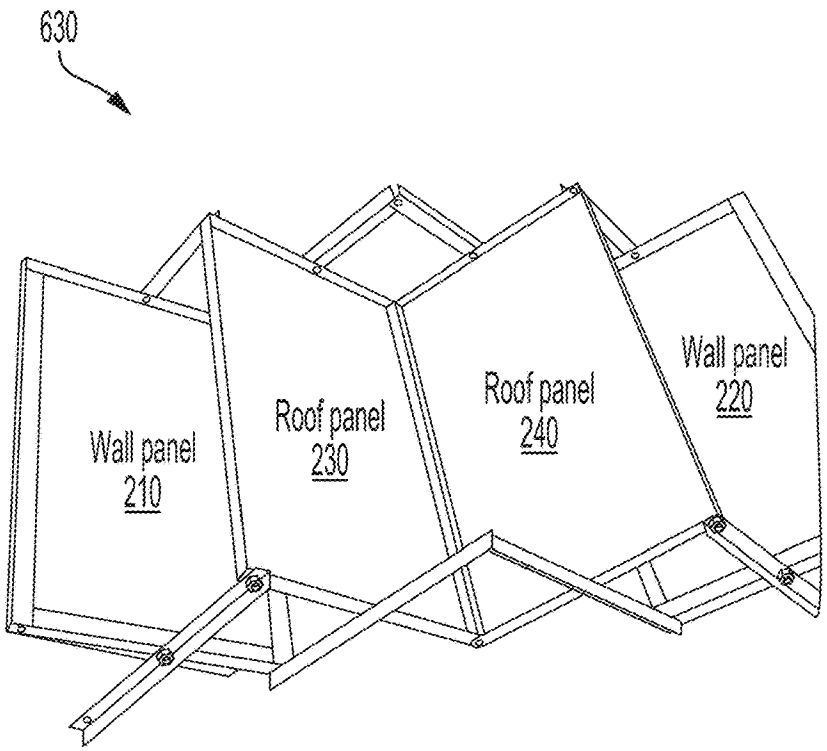
Figure 6C:
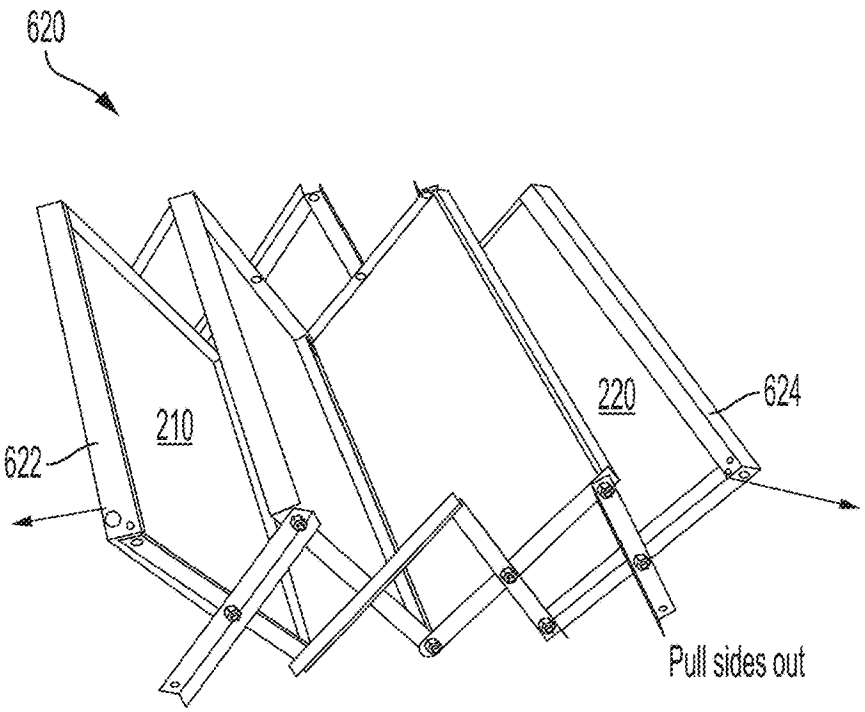

FIGS. 6C and 6D illustrate the portable, erectable shelter 200 of FIG. 2 in a first expanding position 620 and a second expanding position 630. The first expanding position 620 of the portable, erectable shelter 200 is achieved by pulling ends of the first wall panel 210 and the second wall panel 220 in opposite directions indicated by arrows 622 and 624. As shown in FIG. 6D, in the second expanding position 630, the first wall panel 210 and the second wall panel 220 rotate. For example, the first wall panel 210 rotates in a counter-clockwise direction, whereas the second wall panel 220 rotates in a clockwise direction, which eventually lifts the first roof panel 230 and the second roof panel 240, as shown in FIG. 6F.

Figure 6F:
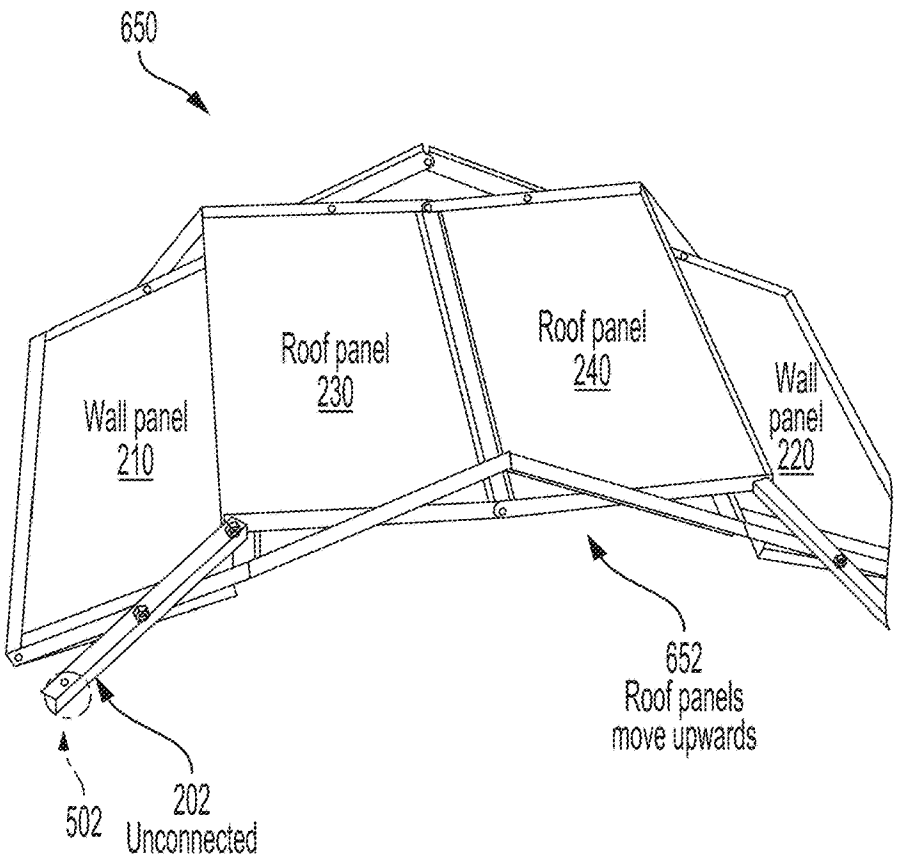
Figure 6E:
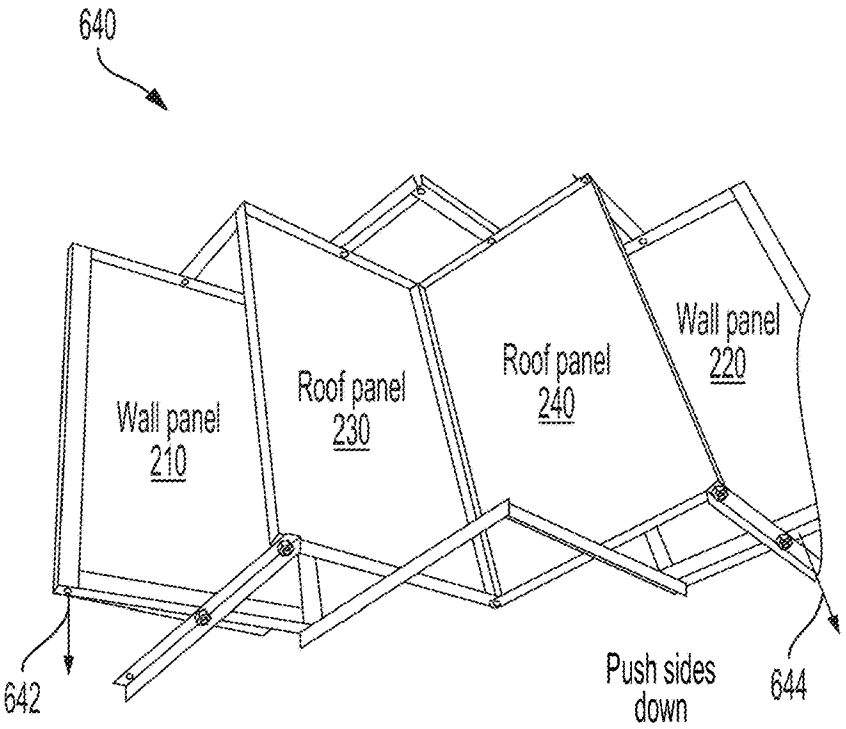

FIGS. 6E and 6F further illustrate the portable, erectable shelter 200 of FIG. 2 in a third expanding position 640 and a fourth expanding position 650. The third expanding position 640 of the portable, erectable shelter 200 is achieved by pushing down on ends of the first wall panel 210 and the second wall panel 220 in a downward direction indicated by arrows 642 and 644. As shown in FIG. 6F, in the fourth expanding position 650, the first wall panel 210 and the second wall panel 220 further rotate. In this example, the first wall panel 210 continues to rotate in a counter-clockwise direction, whereas the second wall panel 220 continues to rotate in a clockwise direction.

As further shown in FIGS. 6E and 6F, pulling out the sides of the first wall panel 210 and the second wall panel 220 and pushing them down causes the first roof panel 230 and the second roof panel 240 to extend outward and upward, as shown by an arrow 652. Because the free end 502 of the first outer wall truss link 202 of the first wall panel 210 is not connected to another structure, the first wall panel 210 and the second wall panel 220 may be rotated to a vertical position.

Figure 6H:
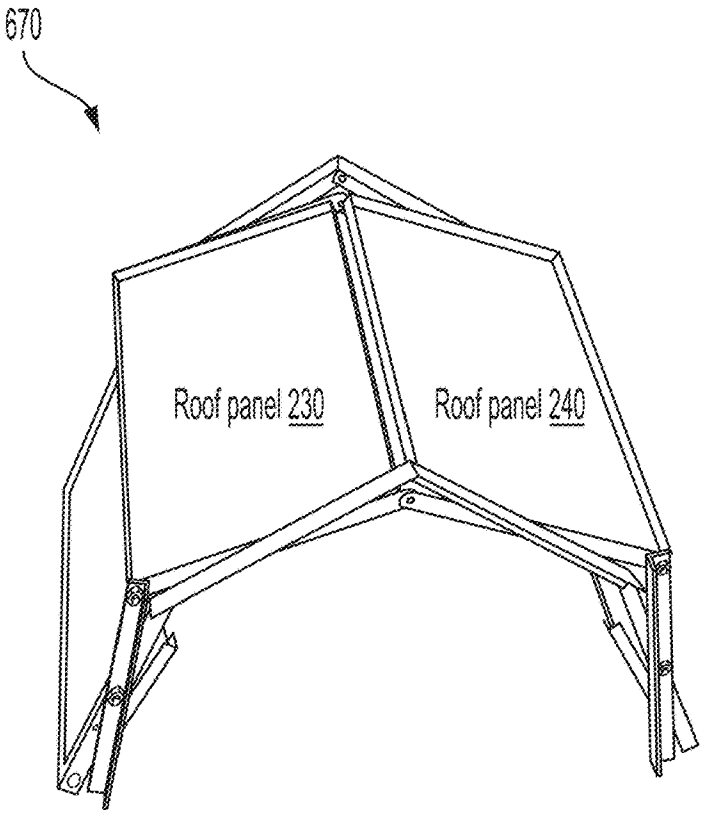
Figure 6G:
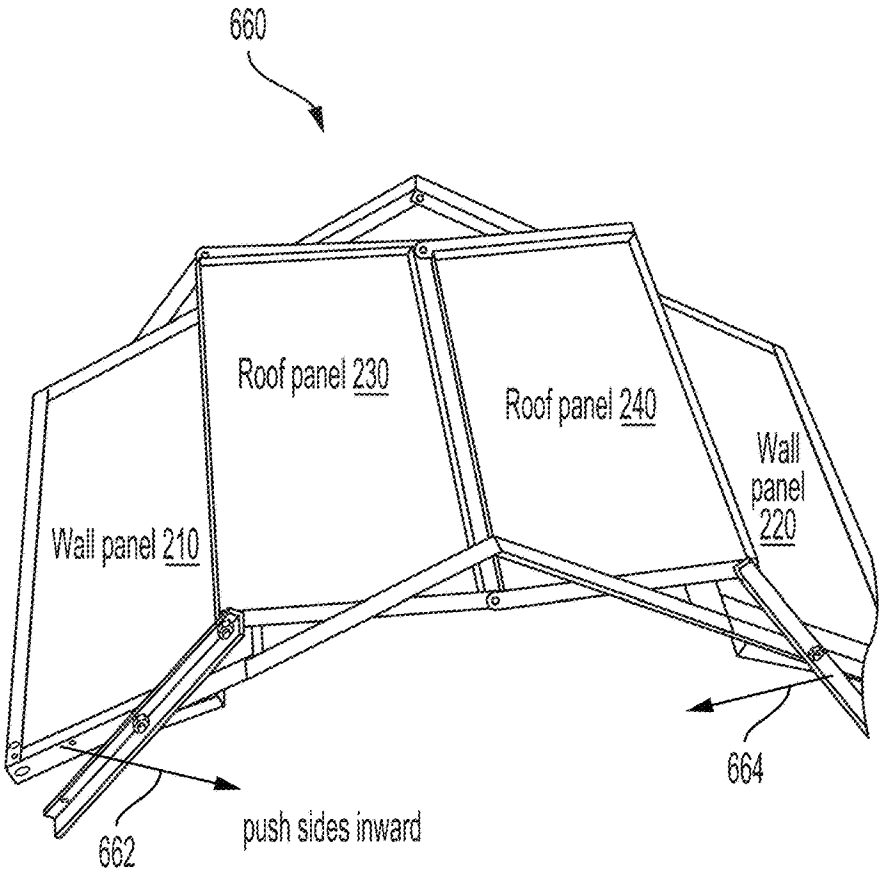

FIGS. 6G and 6H further illustrate the portable, erectable shelter 200 of FIG. 2 in a first rotated position 660 and a second rotated position 670. The first rotated position 660 of the portable, erectable shelter 200 is achieved by pushing down and inward on ends of the first wall panel 210 and the second wall panel 220 in directions indicated by arrows 662 and 664. As shown in FIG. 6H, in the second rotated position 670, the first wall panel 210 and the second wall panel 220 are further rotated. The first wall panel 210 continues to rotate in a counter-clockwise direction, whereas the second wall panel 220 continues to rotate in a clockwise direction to a vertical position. In this example, the first wall panel 210 and the second wall panel 220 rotate to a vertical position while the first roof panel 230 and the second roof panel 240 rotate to an angled position.

Figure 6J:
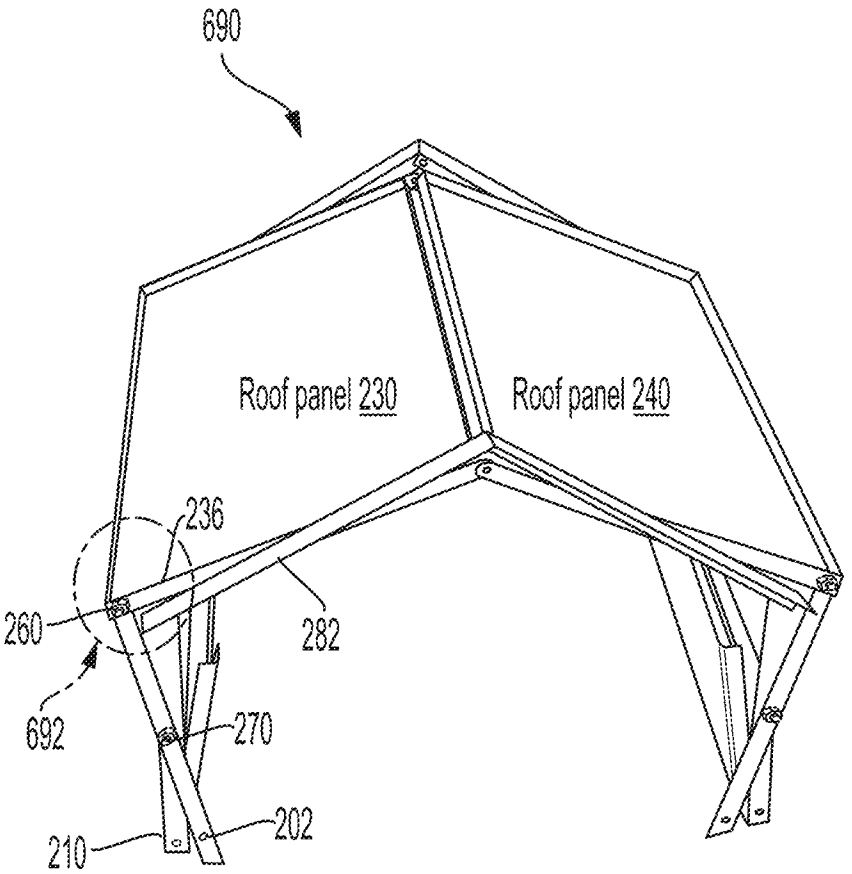
Figure 6I:
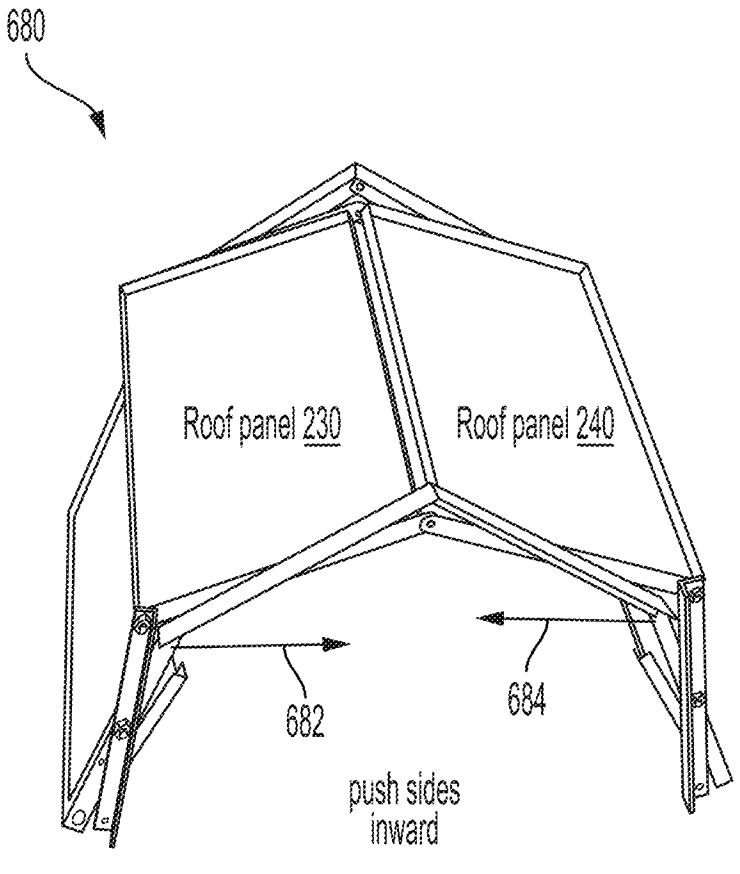

FIGS. 6I and 6J further illustrate the portable, erectable shelter 200 of FIG. 2 in a third rotated position 680 and an erect position 690. The third rotated position 680 of the portable, erectable shelter 200 is achieved by pushing inward on ends of the first wall panel 210 and the second wall panel 220 in directions indicated by arrows 682 and 684. As shown in FIG. 6J, in the erect position 690, the first wall panel 210 and the second wall panel 220 are completely rotated. The first wall panel 210 completes counter-clockwise rotation, whereas the second wall panel 220 completes clockwise rotation to a vertical position. In this example, an end of an outer truss link of the roof truss link pair butts against an end of an outer truss link of the wall truss link pair, as highlighted with reference number 692. This abutment of the outer truss links provides structural support for the portable, erectable shelter 200.

Figure 6K:
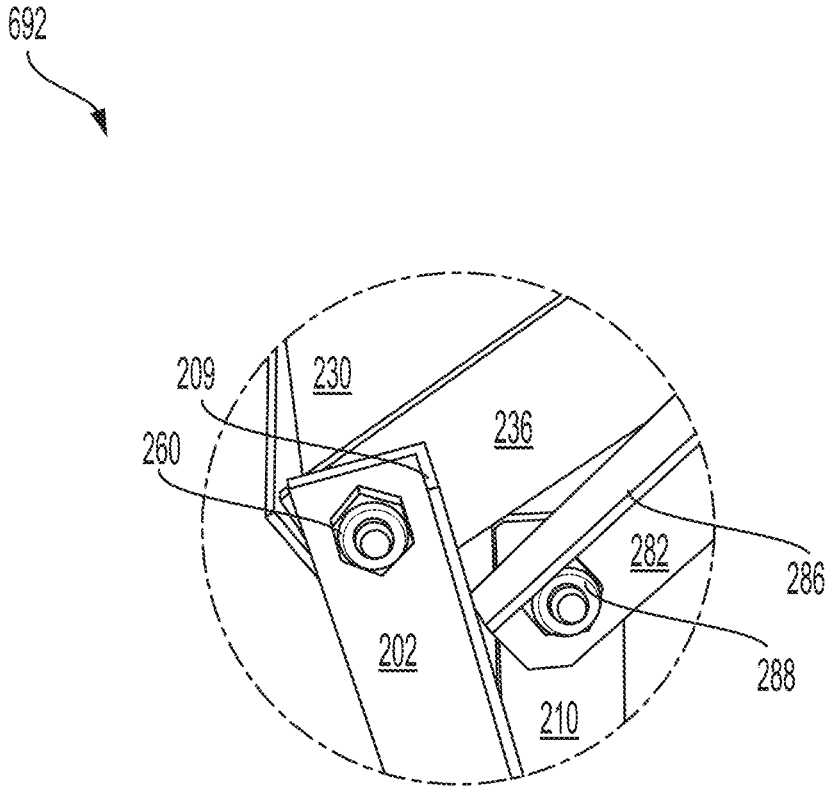

FIG. 6K is a blowup illustration of the circled portion of the portable, erectable shelter 200 of FIG. 2, as highlighted with reference number 692 in FIG. 6J, according to aspects of the present disclosure. In the collapsed state of the portable, erectable shelter 200 shown in FIG. 6A, a pair of wall panels (e.g., the first wall panel 210 and the second wall panel 220) are arranged outermost from a pair roof panels (e.g., the first roof panel 230 and the second roof panel 240). In this configuration, the pair of roof panels (e.g., the first roof panel 230 and the second roof panel 240) are arranged between the pair of wall panels (e.g., the first wall panel 210 and the second wall panel 220) in a collapsed, vertical position for storage or transport.

As shown in FIGS. 6J and 6K, the first outer wall truss link 202 is rotatably fixed to a sidewall of the first wall panel 210 through the first truss pair link connector 270 (see FIG. 2). The first outer wall truss link 202 includes a first end pivotally secured to a first corner of the first roof panel 230 through the first end connector 260. The first outer wall truss link 202 also includes a free end (e.g., the free end 502 of FIG. 5) opposite the first end. In one configuration, the first outer roof truss link 282 (e.g., of the first roof truss link pair 580 of FIG. 5) is rotatably fixed to a sidewall (e.g., the first inner truss link 236) of the first roof panel 230.

As shown in FIG. 6K, the first outer roof truss link 282 includes a first end pivotally secured to a first corner (e.g., the first inner truss link 216 of FIG. 2) of the first wall panel 210 through a first end connector 288. In this configuration, the first end of the first outer wall truss link 202 abuts the first end of the of the first outer roof truss link 282 in the erect position 690.

In the configuration shown in FIG. 6K, the first outer wall truss link 202 includes a flanged sidewall portion 209, extending away from a flat portion of the first outer wall truss link 202. The flat portion of the first outer wall truss link 202 is secured to the first inner truss link 236 of the first roof panel 230 through the first end connector 260. In addition, the first outer roof truss link 282 includes a flanged sidewall portion 286, extending away from a flat portion of the first outer roof truss link 282. The flat portion of the first outer roof truss link 282 is secured to the first inner truss link 216 of the first wall panel 210 through the first end connector 288. In this configuration, the flanged sidewall portion 209 of the first outer wall truss link 202 directly abuts the flanged sidewall portion 286 of the first outer roof truss link 282 in the erect position.

Figure 7B:
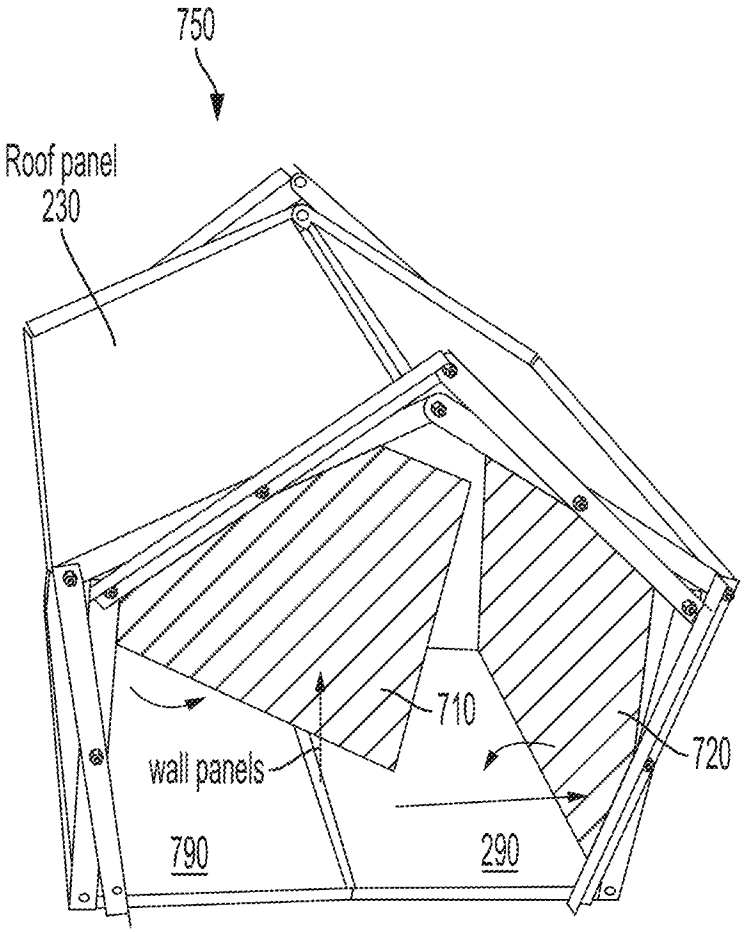
FIGS. 7A and 7B further depict formation of the interior of the portable, erectable shelter of FIG. 2 in a first interior stage and a second interior stage, according to aspects of the present disclosure.
Figure 7A:
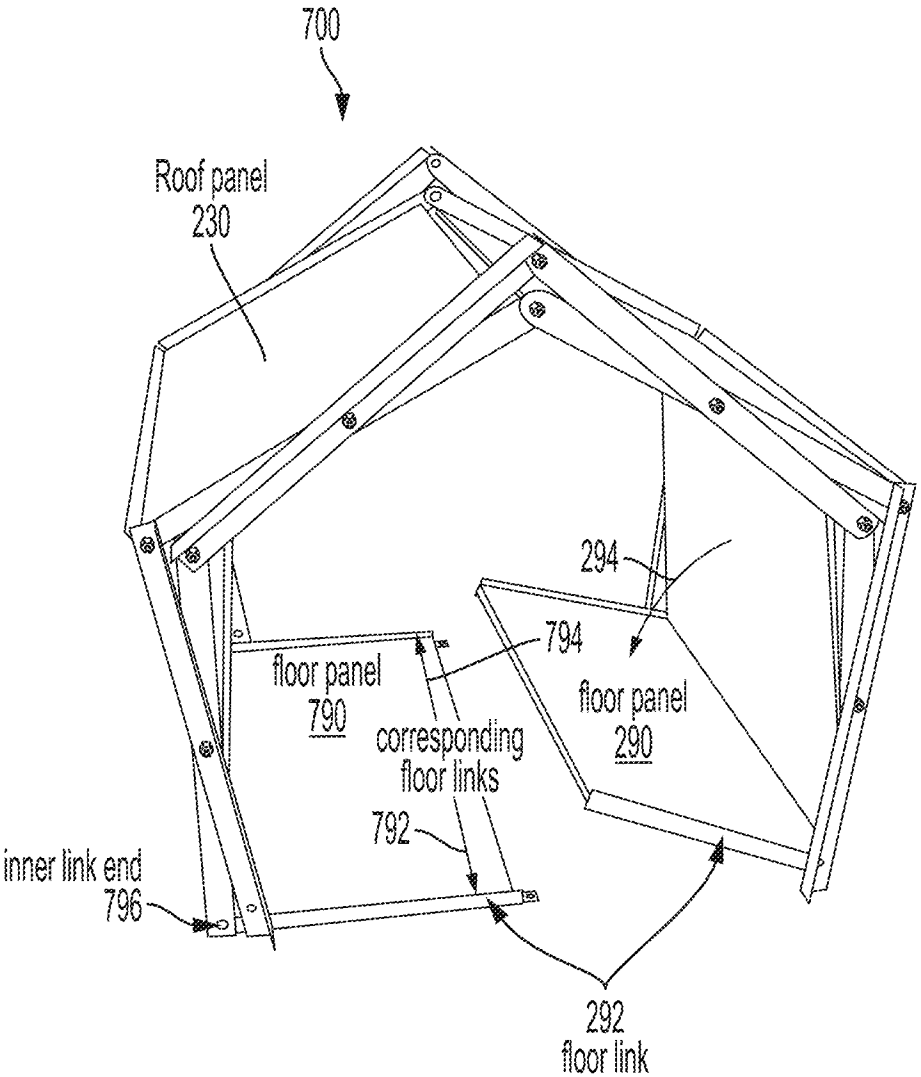

FIGS. 7A and 7B further illustrate formation of the interior of the portable, erectable shelter 200 of FIG. 2 in a first interior stage 700 and a second interior stage 750, according to aspects of the present disclosure. The first interior stage 700 of the portable, erectable shelter 200 is achieved by moving the floor panel 290 from a vertical position to a horizontal position. The floor panel 290 also includes a first floor link 292 and a second floor link 294. In this example, an additional floor panel 790 is shown in a horizontal position and includes a first floor link 792 and a second floor link 794. The first floor link 792 and the second floor link 794 may be pivotally connected to an end of each inner truss link of the wall truss link pairs using an inner link end 796. The first floor link 292 and the second floor link 294 form the floor panel 290. In addition, the first floor link 792 and the second floor link 794 form the additional floor panel 790 The corresponding floor links (e.g., 792/794) may attach to adjacent floor links (e.g., 292/294) for added stability.

FIG. 7B illustrates the second interior stage 750 of the portable, erectable shelter 200. In this configuration, the interior of the portable, erectable shelter 200 includes a first wall panel 710 and a second wall panel 720. Representatively, the first wall panel 710 and the second wall panel 720 may be pivotally connected to each inner truss link of the wall truss link pairs. The first wall panel 710 and the second wall panel 720 may pivot outward to be substantially perpendicular to the floor panel 290 and the additional floor panel 790.

Figure 8:
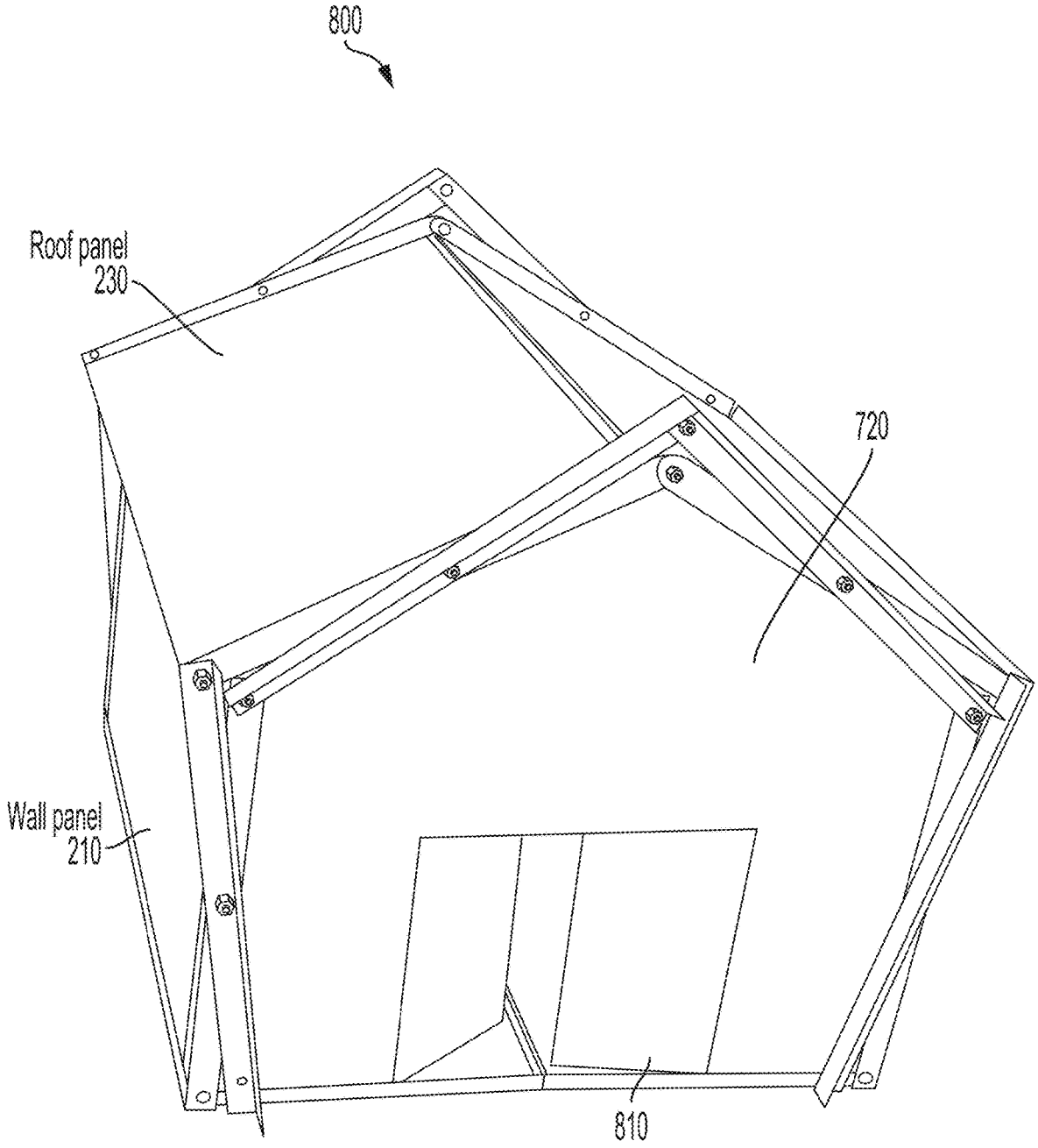
FIG. 8 illustrates a portable, erectable shelter, according to aspects of the present disclosure.

FIG. 8 illustrates a portable, erectable shelter 800, according to aspects of the present disclosure. In this example, doors 810 are built into the second wall panel 720. In another configuration, the front and/or back of the portable, erectable shelter 800 may be open, for example, as shown in FIG. 7A. In further configurations, fixtures, such as piping, electrical wiring, Internet wiring, and other like fixtures, may be pre-installed into the first wall panel 210 and/or the first roof panel 230.

FIGS. 9A-9E illustrate alternative structural configurations for a portable, erectable shelter 900, according to aspects of the present disclosure. Aspects of the disclosure are not limited to four truss link pair, such as the portable, erectable shelter 200 shown in FIG. 2. In one configuration, additional truss link pairs are used.

Figure 9A:
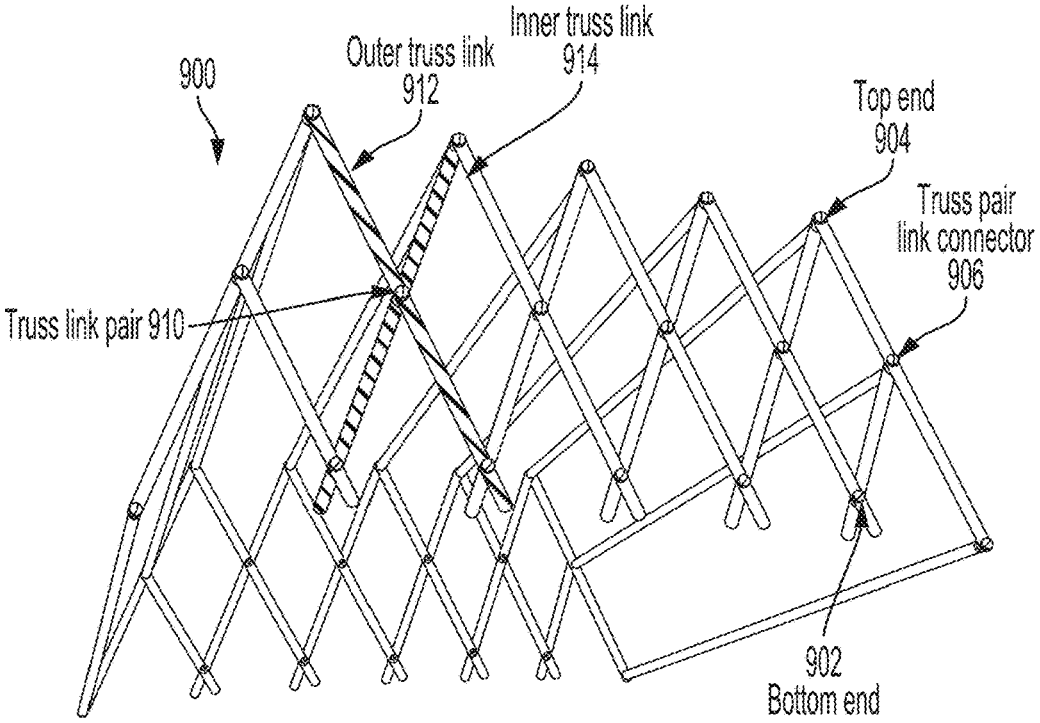
FIGS. 9A-9E illustrate alternative structural configurations for a portable, erectable shelter, according to aspects of the present disclosure.

FIG. 9A illustrates the portable, erectable shelter 900, including six truss link pairs. In this example, a first truss link pair 910 includes a first outer truss link 912 and a first inner truss link 914. The first outer truss link 912 of the first truss link pair 910 may be pivotally connected to the first inner truss link 914 of the first truss link pair 910 via a truss pair link connector (e.g., truss pair link connector 906). This example also illustrates a bottom end 902 and a top end 904 of the portable, erectable shelter 900.

Figure 9B:
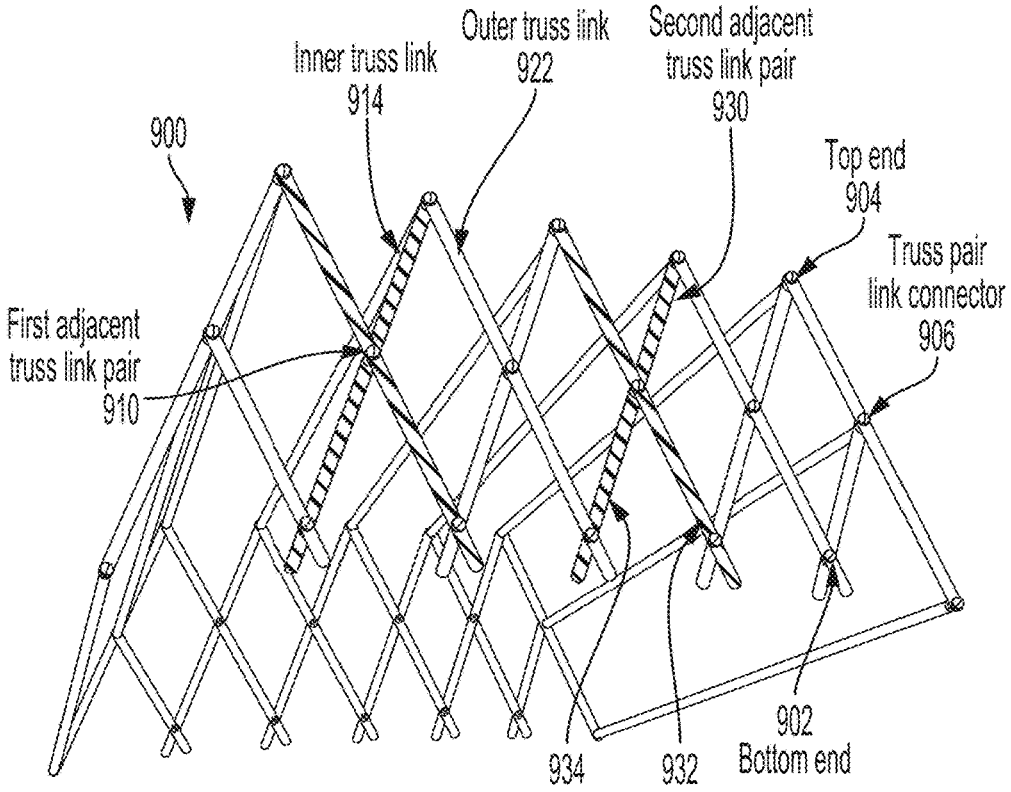

FIG. 9B further illustrates the portable, erectable shelter 900 of FIG. 9A, according to aspects of the present disclosure. In this example, the first truss link pair 910 is identified as a first adjacent truss link pair, and a third truss link pair 930 is identified as a second adjacent truss link pair. A third outer truss link 932 of the third truss link pair 930 may be pivotally connected to a third inner truss link 934 of the third truss link pair 930 via a truss pair link connector (e.g., truss pair link connector 906). For this configuration, a first end (e.g., top end 904) of a second outer truss link 922 is pivotally connected to a top end (e.g., top end 904) of the first inner truss link 914 of the first adjacent inner truss link pair (e.g., the first truss link pair 910). A bottom end (e.g., bottom end 902) of the second outer truss link 922 is pivotally connected to a bottom end (e.g., bottom end 902) of a third inner truss link 934 of a second adjacent inner truss link pair (e.g., the third truss link pair 930).

In this configuration, the first adjacent inner truss link pair (e.g., 910) is adjacent to one side of the second outer truss link 922 and the second adjacent inner truss link pair (e.g., 930) is adjacent on an opposite side of the second outer truss link 922. In addition, the truss links (e.g., first inner truss link 914 and second outer truss link 922) connected at a top end connection (e.g., 904) are connected in a "V" shape. The truss links (e.g., third inner truss link 934 and second outer truss link 922) connected at a bottom end (e.g., 902) are connected in an "X" shape.

Figure 9C:
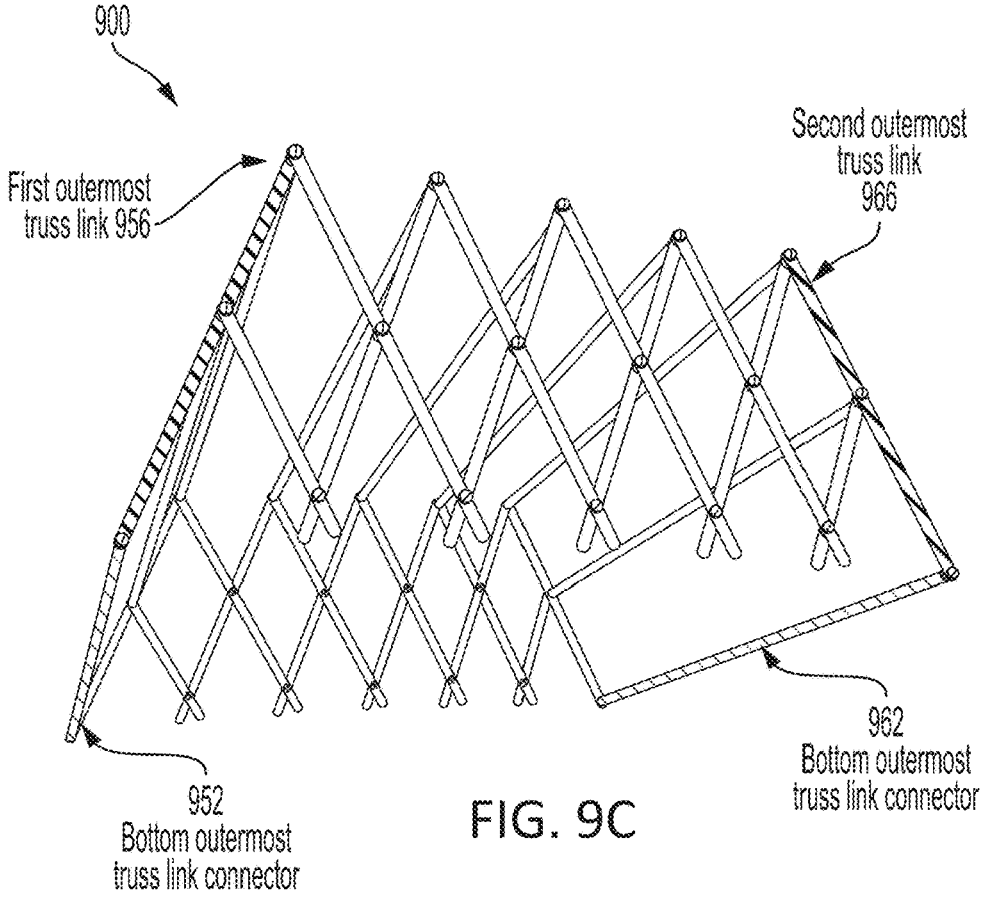

FIG. 9C further illustrates the portable, erectable shelter 900 of FIG. 9A, according to aspects of the present disclosure. In this example, the portable, erectable shelter 900 includes two outermost outer truss links (e.g., a first outermost truss link 956 or first outermost outer truss link and second outermost truss link 966 or second outermost outer truss link). The portable, erectable shelter 900 also includes two outermost truss link connectors (e.g., a bottom outermost truss link connector 952 and a bottom outermost truss link connector 962). In this arrangement, a bottom end of the first outermost truss link 956 is connected to a bottom outermost truss link connector 952. The connection to the bottom outermost truss link connector 952 may be a fixed connection. In addition, a bottom end of the second outermost truss link 966 is connected to the bottom outermost truss link connector 962. Furthermore, each bottom outermost link connector (e.g., 952/962) is also connected to an opposing outermost truss link.

Figure 9D:
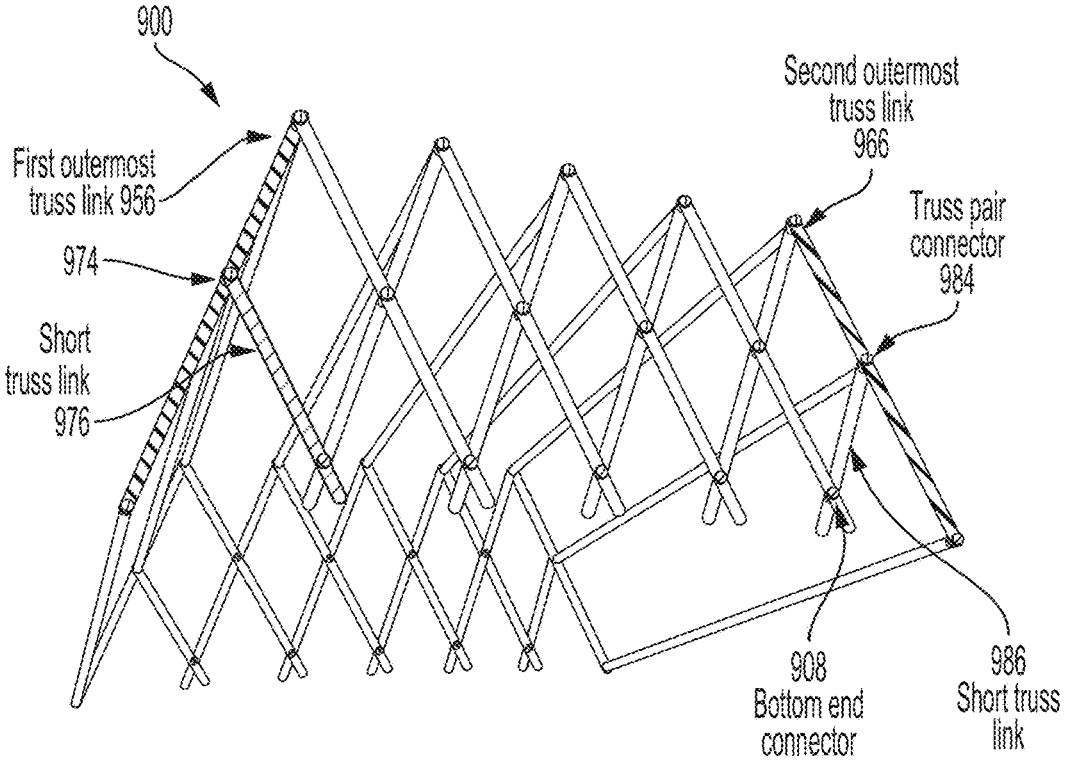

FIG. 9D further illustrates the portable, erectable shelter 900 of FIG. 9A, according to aspects of the present disclosure. In this example of the portable, erectable shelter 900, the first outermost truss link 956 is connected to a short truss link 976 at a truss pair connector 974. Similarly, the second outermost truss link 966 is connected to a short truss link 986 at a truss pair connector 984. In this arrangement, the short truss link (e.g., 976/986) includes two attachment points: 1) a bottom end connection 908 to an adjacent truss link (e.g., 910/930); and 2) a truss pair connector (e.g., 974/984) connection to an outermost truss link (e.g., 956/966). Because the short truss link (e.g., 976/986) includes two connections in this configuration, a wall panel (see FIG. 9E) may stand vertically. The vertical position of the wall panel causes roof panels (see FIG. 10I) to be in an angled position, thereby erecting the portable, erectable shelter 900.

Figure 9E:
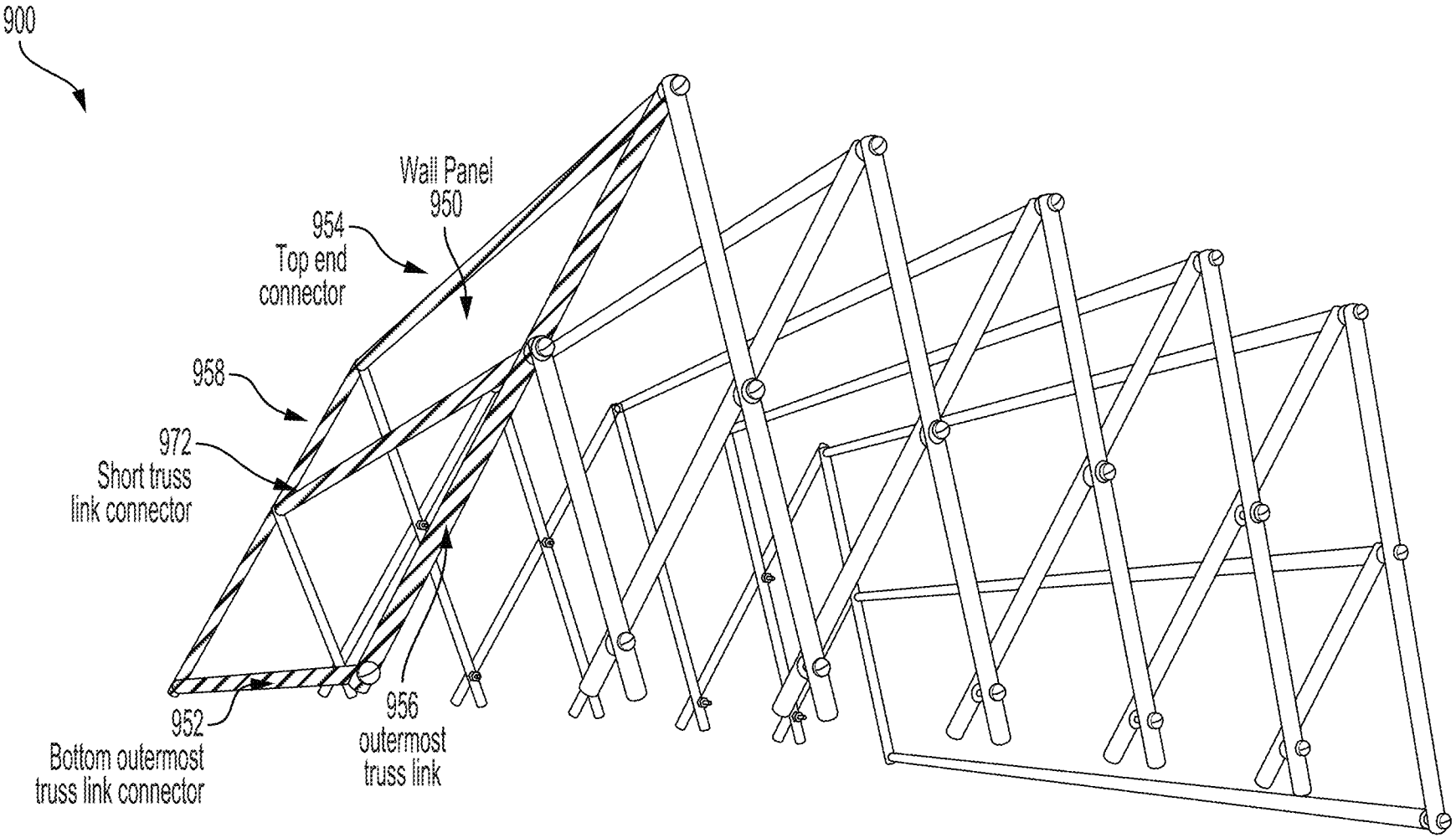

FIG. 9E further illustrates the portable, erectable shelter 900 of FIG. 9A, according to aspects of the present disclosure. In this example, the portable, erectable shelter 900 includes a wall panel 950 framed by the first outermost truss link 956, a second outermost truss link 958, a top end link connector 954, and the bottom outermost truss link connector 952. The wall panel 950 also includes a short truss link connector 972 that joins the first outermost truss link 956 and the second outermost truss link 958. The wall panel 950 may be covered with a material prior to, or after, erecting the portable, erectable shelter 900. Sample materials for the wall and roof panels as well the structure of the portable, erectable shelter may include thin aluminum sheet connected to the trusses of each panel. Alternatively, the aluminum sheet could be fabric attached to the trusses of each panel.

FIGS. 10A-10I depict a process of erecting the portable, erectable shelter 900 of FIG. 9A, according to aspects of the present disclosure. The process of erecting the portable, erectable shelter 900 of FIG. 9A begins at FIG. 10A.

Figure 10B:
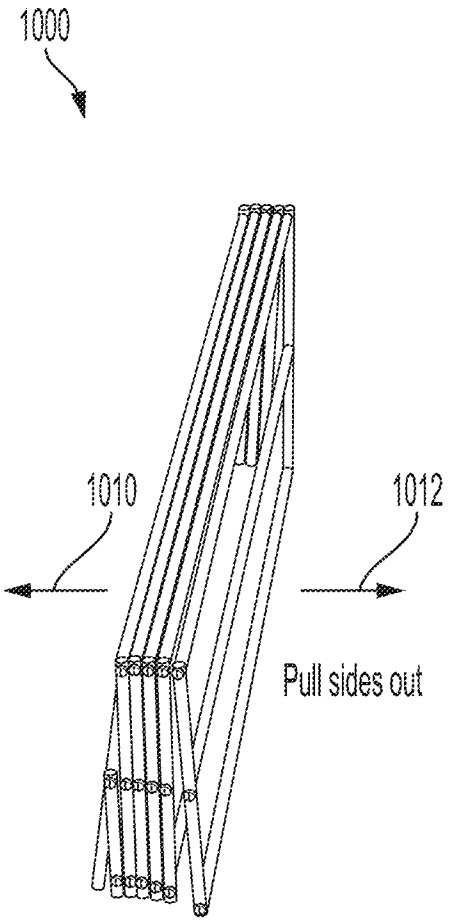
FIGS. 10A-10I depict a process of erecting the portable, erectable shelter of FIG. 9A, according to aspects of the present disclosure.
Figure 10A:
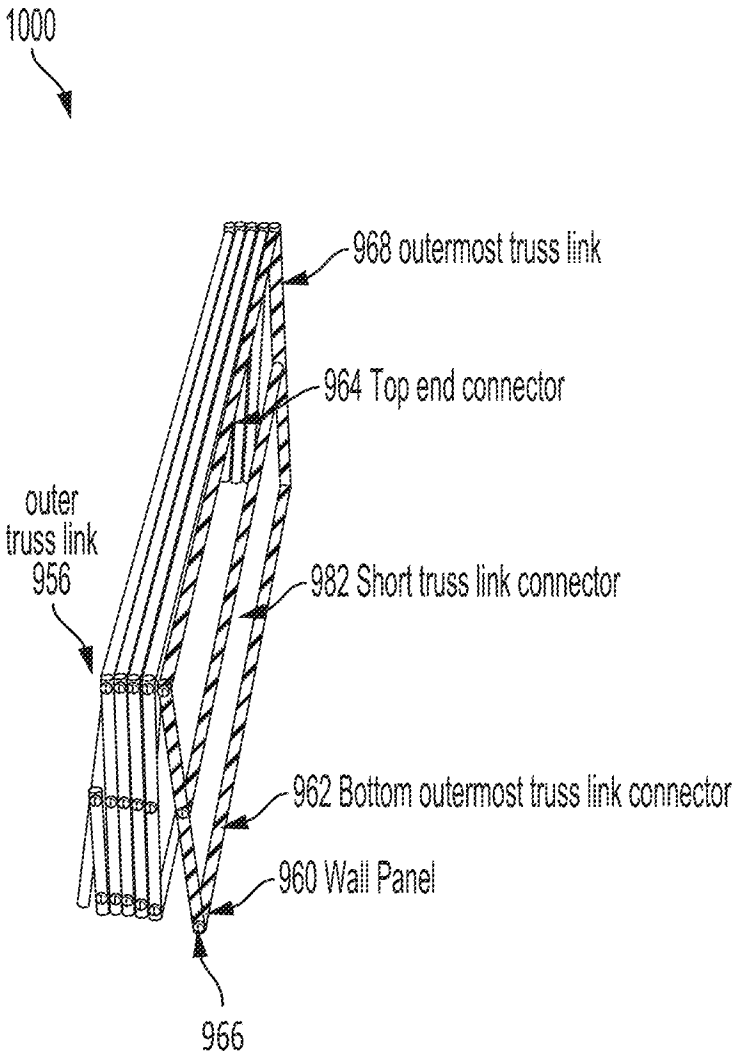

FIG. 10A illustrates the portable, erectable shelter 900 of FIG. 9A in a collapsed position 1000. The collapsed position 1000 of the portable, erectable shelter 900 shows a wall panel 960 opposite the wall panel 950 shown in FIG. 9E, including the first outermost truss link 956. In this configuration, the wall panel 960 includes the second outermost truss link 966 and an outermost truss link 968 joined by the bottom outermost truss link connector 962 and a top end truss link connector 964. The wall panel 960 also includes a short truss link connector 982 connected to the second outermost truss link 966 and the outermost truss link 968.

FIG. 10B further illustrates the portable, erectable shelter 900 of FIG. 9A in the collapsed position 1000. The portable, erectable shelter 900 is transformed from the collapsed position 1000 to an expanding position by pulling sides of the portable, erectable shelter 900 in opposite directions indicated by arrows 1010 and 1012. FIG. 10C also illustrates the portable, erectable shelter 900 of FIG. 9A in the collapsed position 1000. The portable, erectable shelter 900 may collapse to the collapsed position 1000 shown in FIGS. 10A to 10C, as a reduced structure (e.g., useful for saving storage/travel space). In addition, the wall panels (e.g., 950/960) reside on both ends of the portable, erectable shelter 900 in the collapsed position 1000.

Figure 10D:
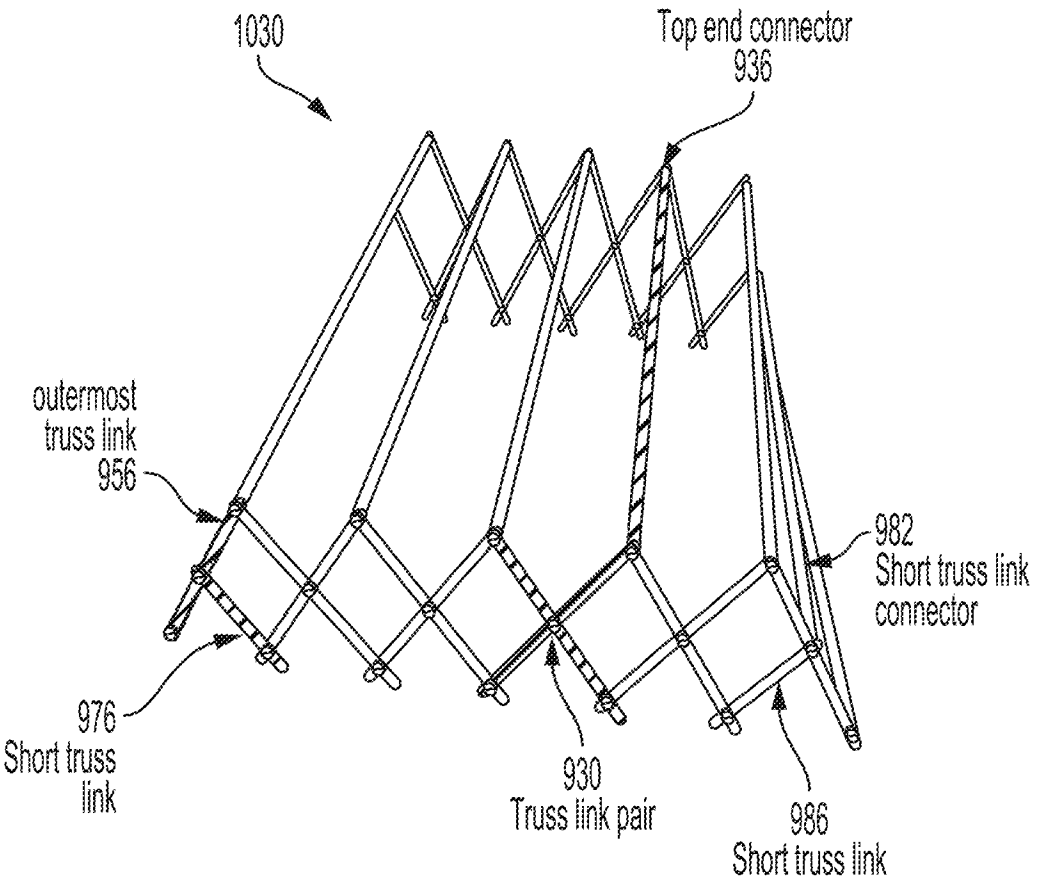
Figure 10C:
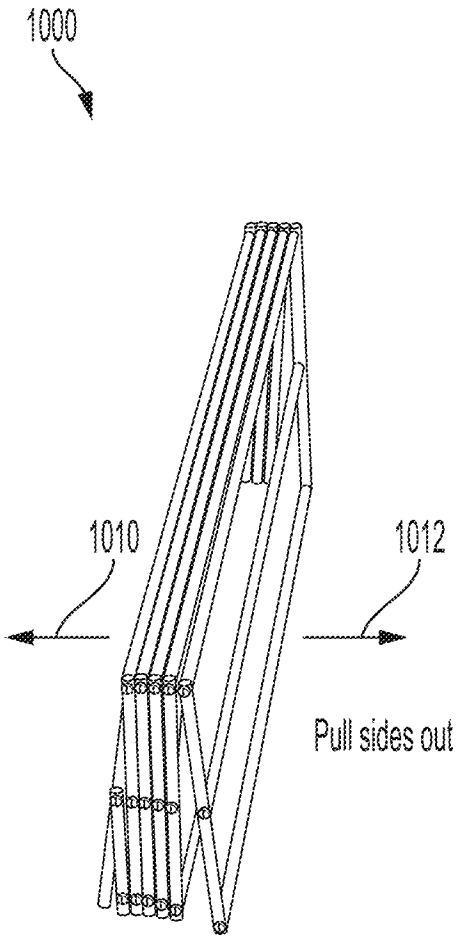

FIG. 10D illustrates the portable, erectable shelter 900 of FIG. 9A in a first expanding position 1030, according to aspects of the present disclosure. The portable, erectable shelter 900 expands outward when the sides are pulled in the first expanding position 1030. This first expanding position 1030 illustrates the first outermost truss link 956 secured to the short truss link 976. The first expanding position 1030 also shows the third truss link pair 930 as well as a top end link connector 936. In addition, the short truss link 986 as well as the short truss link connector 982 are also shown.

Figure 10F:
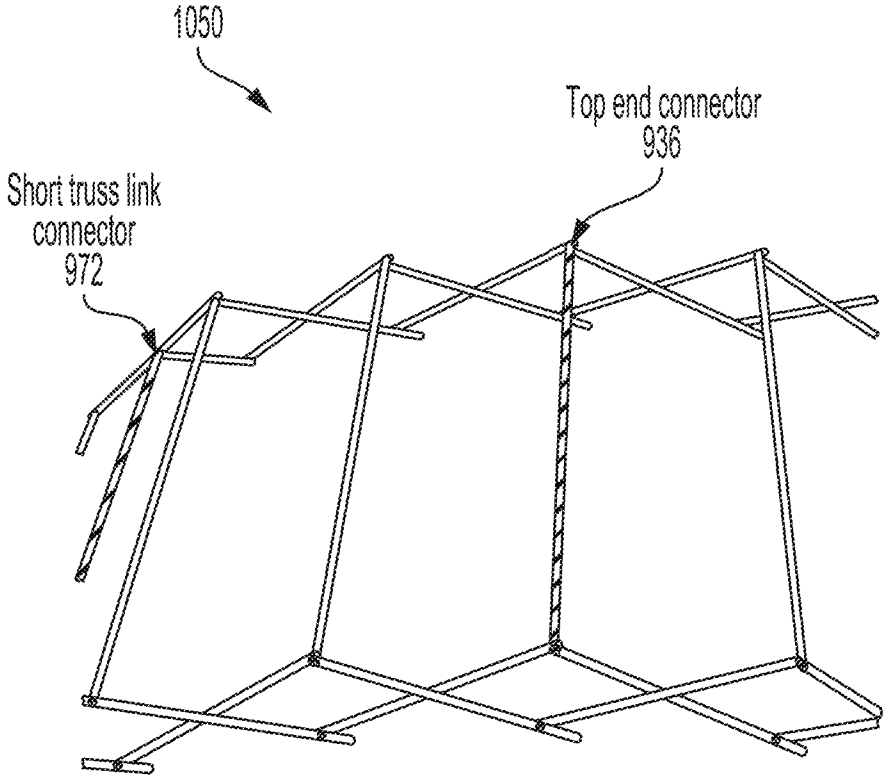
Figure 10E:
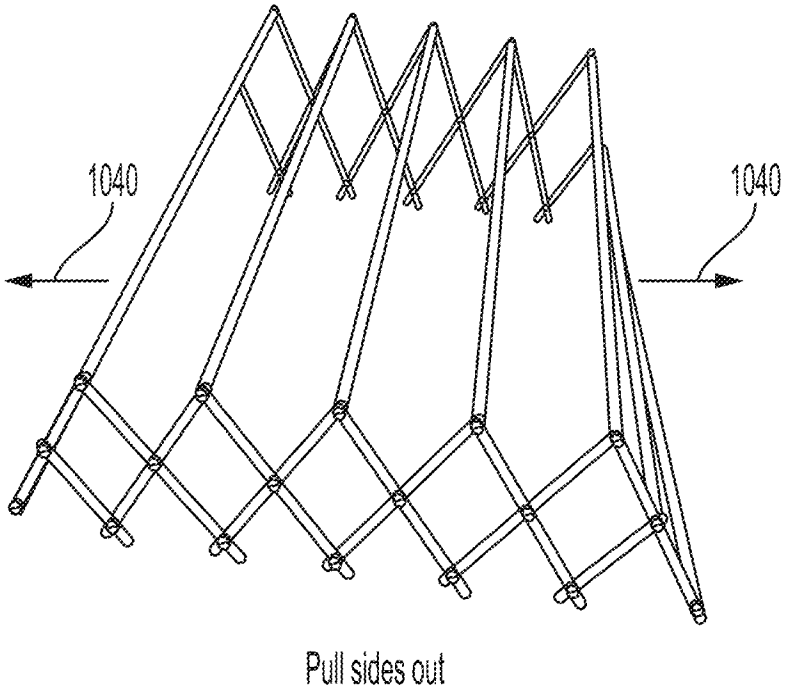

FIG. 10E illustrates the portable, erectable shelter 900 of FIG. 9A, prior to transitioning from the first expanding position 1030 to the second expanding position 1050 (see FIG. 10F). FIG. 10F illustrates the portable, erectable shelter 900 of FIG. 9A, after transitioning from the first expanding position 1030 to the second expanding position 1050 by pulling the sides of the portable, erectable shelter 900 in opposing directions indicated by arrows 1040 and 1042 (as shown in FIG. 10E). This second expanding position 1050 highlights the short truss link connector 972 as well as the top end link connector 936.

Figure 10G:
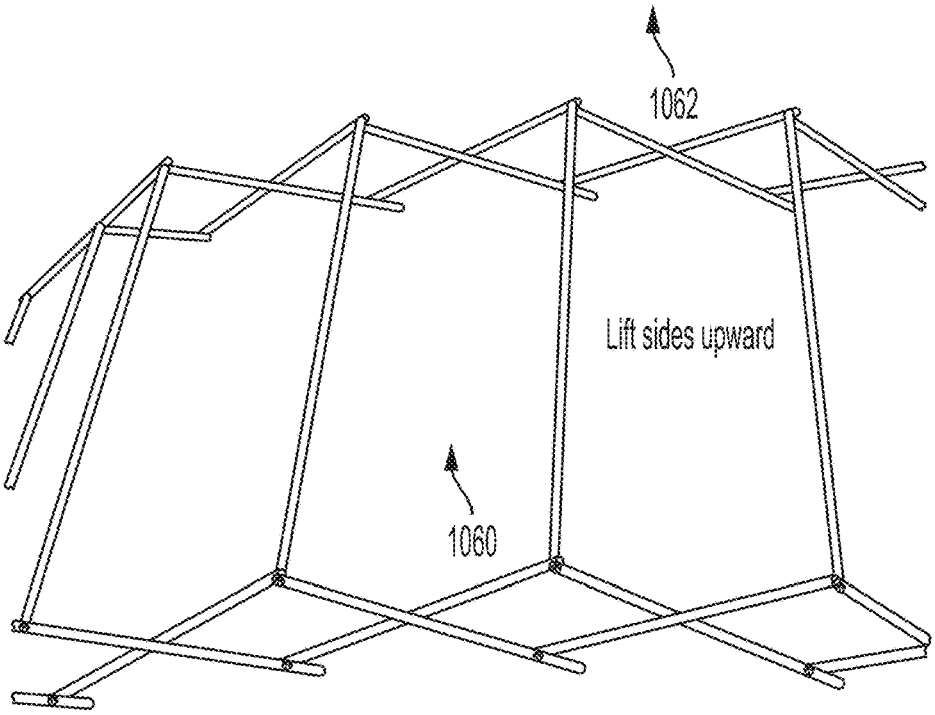
Figure 10H:
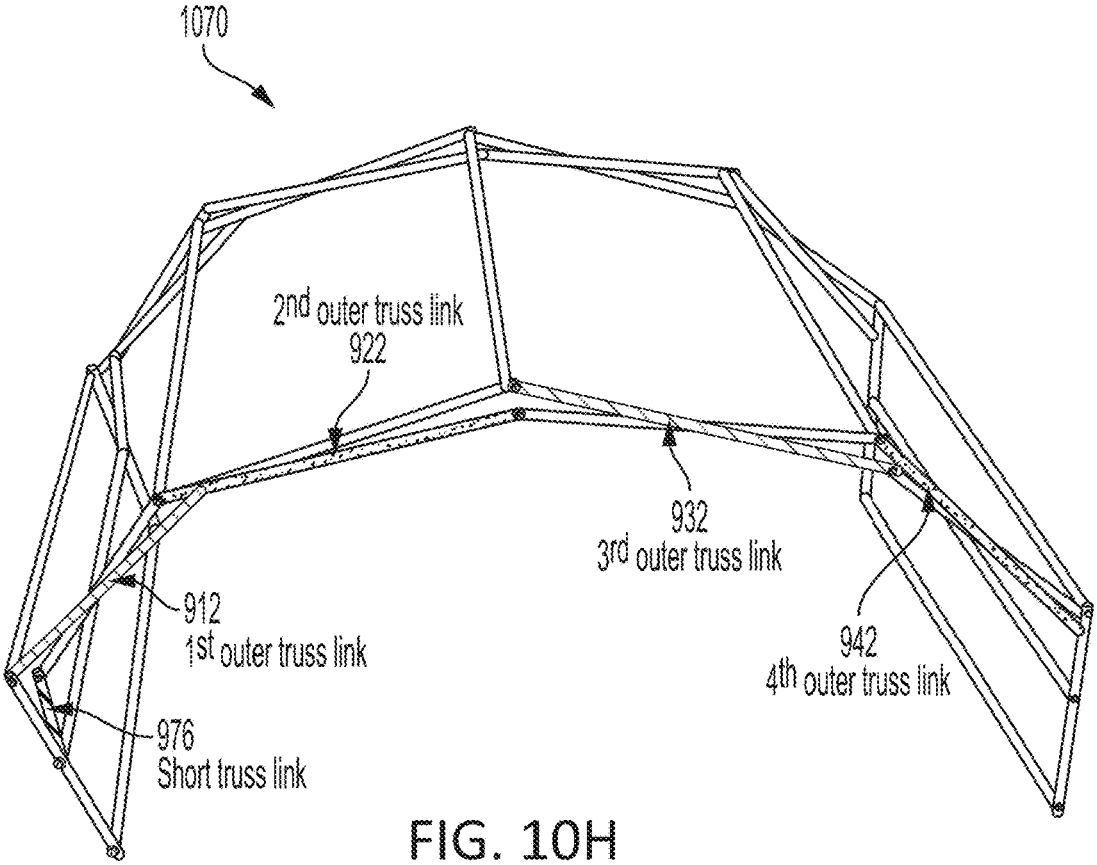

FIG. 10G illustrates the portable, erectable shelter 900 of FIG. 9A, prior to transitioning from the second expanding position 1050 to an erect position 1070 (see FIG. 10H). FIG.

10H illustrates the portable, erectable shelter 900 of FIG. 9A, after transitioning from the second expanding position 1050 to the erect position 1070 by lifting the portable, erectable shelter 900 upward, in the direction indicated by arrows 1060 and 1062 (as shown in FIG. 10G).

FIG. 10H illustrates the portable, erectable shelter 900 in the erect position 1070. This erect position 1070 highlights support, including the short truss link 976, the first outer truss link 912, the second outer truss link 922, the third outer truss link 932, and the fourth outer truss link 942. In this configuration, support of the portable, erectable shelter 900 is provided by the truss links butting one another. For example, the short truss link 976 is pressed against the first outer truss link 912. Similarly, the first outer truss link 912 is press against the second outer truss link 922. The second outer truss link 922 is pressed against the third outer truss link 932. Finally, the third outer truss link 932 is pressed against a fourth outer truss link 942 in the erect position. Because each outer truss link butts an adjacent truss link, the stability of the portable, erectable shelter 900 is improved.

Figure 10I:
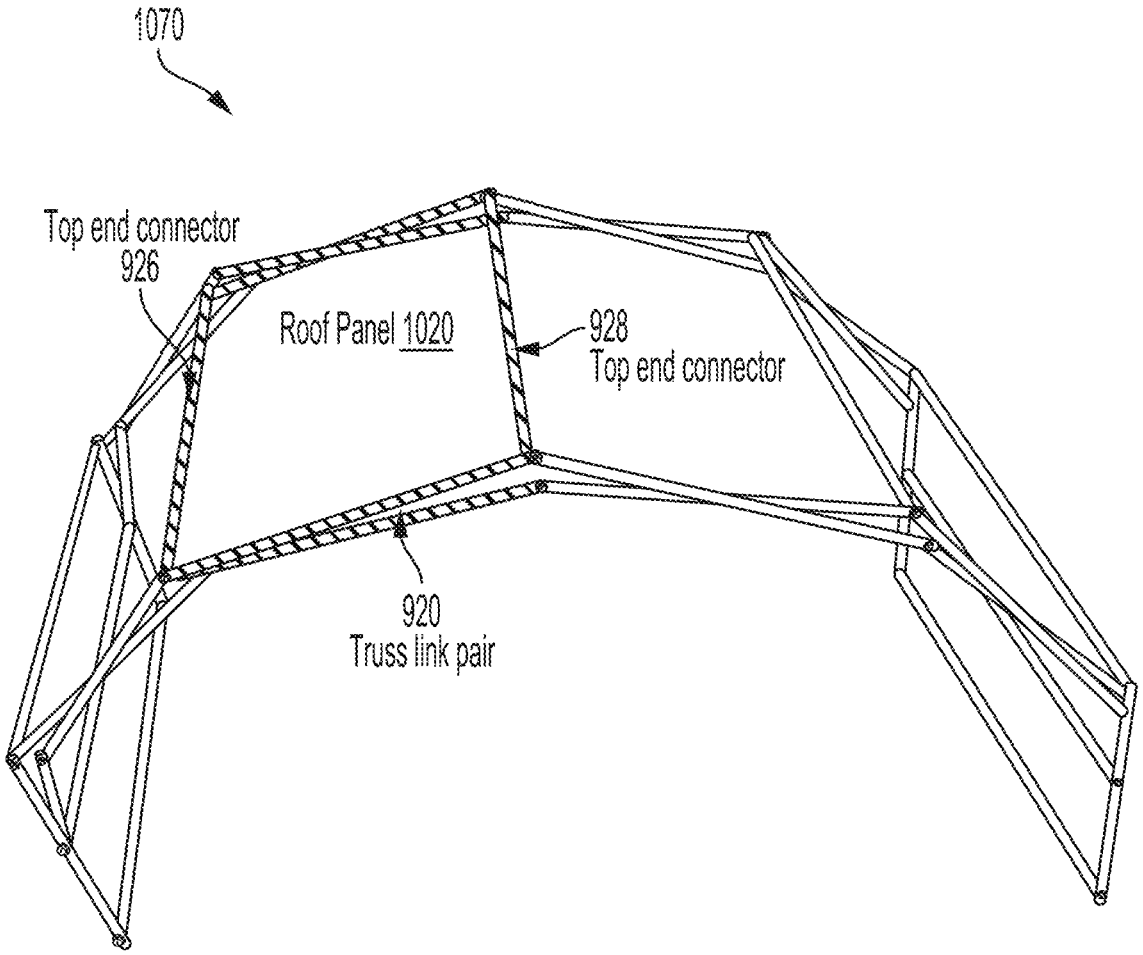

FIG. 10I further illustrates the portable, erectable shelter 900 in the erect position 1070, according to aspects of the present disclosure. In this example, a roof panel 1020 may be formed from two top adjacent top end connectors (e.g., 926 and 928) and the corresponding truss link pairs (e.g., the second truss link pair 920). The truss link pairs used to form the roof panel 1020 may be referred to as roof truss link pairs. In this configuration, the roof panel and/or the wall panel (e.g., 950/960) may be covered with a material. In further configurations, fixtures, such as piping, electrical wiring, Internet wiring, and other like fixtures, may be pre-installed into the first wall panel 210 and/or the first roof panel 230.

According to this aspect of the present disclosure, the portable, erectable shelter may be manually expanded from the collapsed position to the assembled position. The assembled position may refer to the erect or upright position. When in the collapsed position, the wall panels lie outermost and the roof panels are defined between the wall panels. The wall panels and roof panels may be perpendicular to a ground surface when the shelter is in the collapsed position.

When expanded, the roof panels form an angled roof and the wall panels are placed in a vertical position that is substantially perpendicular to the ground. Additionally, an end of an outer truss link may be adjoined with an end of another truss link. For example, an end of one outer truss link may butt against an end of an adjacent outer truss link. The adjoined outer truss links provide additional stability to the erectable structure.

According to aspects of the present disclosure, the erectable shelter may be transported by road or other transportation system to a desired location, such as a disaster area, a temporary camp, or a backyard. The erectable shelter may be used for a variety of purposes, such as, but not limited to temporary housing, permanent housing, animal shelter, storage unit, outdoor venue, etc.

As used herein, a phrase referring to "at least one of" a list of items refers to any combination of those items, including single members. As an example, "at least one of: a, b, or c" is intended to cover: a, b, c, a-b, a-c, b-c, and a-b-c.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above. Various modifications, changes, and variations may be made in the arrangement, operation, and details of the methods and apparatus described above without departing from the scope of the claims.

What is claimed is:

1. A portable erectable shelter, comprising:

a pair of wall panels arranged outermost from a pair roof panels defined between the pair of wall panels in a collapsed, vertical position;

a first outer wall truss link rotatably fixed to an inner truss link of a first wall panel, the first outer wall truss link having:

a first end pivotally secured to a first corner of a first roof panel;

a free end opposite the first end; and a flanged sidewall portion extending from a flat portion;

a first floor link pivotally attached to an inner link end of the inner truss link of the first wall panel;

a first floor panel attached the first floor link; and a first outer roof truss link rotatably fixed to a sidewall of the first roof panel and having a first end pivotally secured to a first corner of the first wall panel, in which the first end of the first outer wall truss link is arranged to abut the first end of the first outer roof truss link in an erect position.

2. The portable erectable shelter of claim 1, in which the flat portion of the first outer wall truss link is secured to a first inner truss link of the first roof panel through a first end connector.

3. The portable erectable shelter of claim 1, in which the first outer roof truss link comprises a flanged sidewall portion extending away from a flat portion.

4. The portable erectable shelter of claim 3, in which the flat portion of the first outer roof truss link is secured to the first inner truss link of the first wall panel through a first end connector.

5. The portable erectable shelter of claim 3, in which the flanged sidewall portion of the first outer wall truss link is arranged to directly abut the flanged sidewall portion of the first outer roof truss link in the erect position.

6. The portable erectable shelter of claim 3, in which the flanged sidewall portion of the first outer wall truss link is arranged to directly abut the flanged sidewall portion of the first outer roof truss link at a first end of the first outer roof truss link.

7. The portable erectable shelter of claim 1, in which the shelter is manually erectable.

8. The portable erectable shelter of claim 1, in which the portable erectable shelter comprises an enclosed structure.

9. The portable erectable shelter of claim 8, in which the enclosed structure of the portable erectable shelter comprises doors.

* * * * *